US008011305B2

(12) United States Patent
Al-Kaabi et al.

(10) Patent No.: US 8,011,305 B2
(45) Date of Patent: Sep. 6, 2011

(54) SYMMETRICAL MULTI-UNIT RAILROAD CAR

(75) Inventors: Mohamed Al-Kaabi, Hamilton (CA); Jamal Hematian, Burlington (CA)

(73) Assignee: National Steel Car Limited (CA)

( * ) Notice: Subject to any disclaimer, the term of this patent is extended or adjusted under 35 U.S.C. 154(b) by 1672 days.

(21) Appl. No.: 10/611,659

(22) Filed: Jun. 30, 2003

(65) Prior Publication Data

US 2004/0261650 A1 Dec. 30, 2004

(51) Int. Cl.
*B61D 49/00* (2006.01)

(52) U.S. Cl. ..... 105/3; 105/4.1; 105/4.2; 105/4.3

(58) Field of Classification Search ..... 105/1.4, 105/3, 4.1, 4.2, 4.3, 8.1
See application file for complete search history.

(56) References Cited

U.S. PATENT DOCUMENTS

| | | | | |
|---|---|---|---|---|
| 459,896 | A | | 9/1891 | MacMillan |
| 1,040,529 | A | | 10/1912 | Douglas |
| 1,178,909 | A | | 4/1916 | Fisher |
| 1,452,526 | A | | 4/1923 | Pflager |
| 1,499,510 | A | | 7/1924 | Elliott |
| 1,535,799 | A | | 4/1925 | Adams |
| 1,599,474 | A | | 9/1926 | Koch |
| 1,608,665 | A | | 11/1926 | Pehrson |
| 1,621,979 | A | | 3/1927 | Frelin |
| 1,754,111 | A | | 4/1930 | Latshaw |
| 2,079,747 | A | | 5/1937 | Mussey et al. |
| 2,094,442 | A | | 9/1937 | Blomberg |
| 2,132,001 | A | | 10/1938 | Dean |
| 2,155,615 | A | | 4/1939 | De L. Rice |
| 2,865,306 | A | | 12/1958 | Bock et al. |
| 3,290,058 | A | | 12/1966 | Ellerd |
| 3,371,622 | A | | 3/1968 | Lich |
| 3,399,631 | A | * | 9/1968 | Weber ..... 105/4.1 |
| 3,678,863 | A | | 7/1972 | Pringle |
| 3,721,199 | A | | 3/1973 | Hassenauer |
| 3,871,276 | A | | 3/1975 | Allen |
| 4,191,107 | A | | 3/1980 | Ferris et al. |
| 4,233,909 | A | | 11/1980 | Adams et al. |
| 4,258,628 | A | | 3/1981 | Altherr |
| 4,274,776 | A | | 6/1981 | Paton et al. |
| 4,339,996 | A | | 7/1982 | Brodeur et al. |
| 4,421,339 | A | | 12/1983 | Hagin |
| 4,452,147 | A | | 6/1984 | Jwuc |

(Continued)

FOREIGN PATENT DOCUMENTS

DE 664 933 9/1938

(Continued)

OTHER PUBLICATIONS

1997 Car & Locomotive Cyclopedia of American Practices, (Simmons-Boardman Books, Inc., Omaha, Nebraska) pp. 208-217.

(Continued)

*Primary Examiner* — Mark T Le
(74) *Attorney, Agent, or Firm* — Hahn Loeser & Parks LLP; Michael H. Minns

(57) ABSTRACT

The present invention relates to symmetrical arrangements in multi-unit articulated rail road cars. A multi-unit railroad car has an odd number of railcar units joined end to end by articulated connectors supported by railcar trucks. The railroad car has a transverse centerline. The arrangement of articulated connectors about the transverse centerline is symmetrical.

40 Claims, 26 Drawing Sheets

U.S. PATENT DOCUMENTS 4,456,413 A 6/1984 Pavlick
4,503,779 A 3/1985 Chadwick
4,516,506 A 5/1985 Paton
4,547,107 A 10/1985 Krause
4,590,864 A 5/1986 Przybylinski
4,599,949 A 7/1986 Hill
4,648,764 A 3/1987 Pavlick
4,665,834 A 5/1987 Van Iperen
4,686,907 A 8/1987 Woollam et al.
4,703,699 A 11/1987 Hill
4,718,353 A 1/1988 Schuller et al.
4,750,431 A 6/1988 Yates et al.
4,751,882 A 6/1988 Wheatley et al.
4,754,709 A 7/1988 Gramse et al.
4,756,256 A 7/1988 Rains et al.
4,759,294 A 7/1988 Schuller et al.
4,771,706 A 9/1988 Lindauer et al.
4,782,762 A 11/1988 Johnstone et al.
4,805,743 A 2/1989 Rains
4,807,722 A 2/1989 Jamrozy et al.
4,841,876 A 6/1989 Gramse et al.
4,854,791 A 8/1989 Brown
4,862,810 A 9/1989 Jamrozy et al.
4,864,938 A 9/1989 Hesch et al.
4,876,968 A 10/1989 Lindauer et al.
4,889,055 A 12/1989 Jamrozy et al.
4,893,567 A 1/1990 Hill et al.
4,905,795 A 3/1990 Rains
4,917,019 A 4/1990 Hesch et al.
4,924,779 A 5/1990 Curtis et al.
4,942,824 A 7/1990 Cros
4,947,760 A 8/1990 Dawson et al.
4,958,977 A 9/1990 Snead
5,001,990 A 3/1991 Pavlick
5,036,774 A 8/1991 Curtis et al.
5,052,868 A 10/1991 Hesch et al.
5,054,403 A 10/1991 Hill et al.
5,074,725 A 12/1991 Pavlick
5,090,331 A 2/1992 Hesch et al.
5,097,973 A 3/1992 Spencer
5,131,548 A 7/1992 Chi
5,161,469 A 11/1992 Hesch
5,170,718 A 12/1992 Hill et al.
5,174,211 A 12/1992 Snead
5,207,161 A * 5/1993 Pileggi et al. ..... 105/4.1
5,216,285 A 6/1993 Hilsenteger et al.
5,246,321 A 9/1993 Hesch
5,271,335 A 12/1993 Bogenschutz
5,271,511 A 12/1993 Daugherty, Jr. et al.
5,320,046 A 6/1994 Hesch
5,343,812 A * 9/1994 Ishida ..... 105/4.3
5,392,717 A 2/1995 Hesch et al.
5,407,309 A 4/1995 Hesch et al.
5,438,934 A 8/1995 Goding
5,452,664 A 9/1995 Richmond
5,501,556 A 3/1996 Butcher et al.
5,520,489 A 5/1996 Butcher et al.
5,524,552 A 6/1996 Weber
5,564,341 A 10/1996 Martin
5,657,698 A 8/1997 Black, Jr. et al.
5,690,033 A 11/1997 Andre
5,730,063 A 3/1998 Forbes et al.
5,743,191 A 4/1998 Coslovi
5,743,192 A 4/1998 Saxton et al.
5,782,187 A 7/1998 Black, Jr. et al.
5,794,537 A 8/1998 Zaerr et al.
5,832,839 A 11/1998 Forbes
5,842,821 A 12/1998 Coslovi et al.
6,148,965 A 11/2000 Forbes et al.
6,196,137 B1 3/2001 Forbes
6,205,932 B1 3/2001 Khattab
6,216,604 B1 4/2001 Forbes et al.
6,296,083 B1 10/2001 Forbes et al.
6,539,878 B1 4/2003 Coslovi et al.
6,550,400 B1 4/2003 Forbes
6,551,039 B1 4/2003 Forbes
6,584,912 B2 7/2003 Forbes
6,659,016 B2 12/2003 Forbes
6,666,148 B1 12/2003 Coslovi et al.
2002/0134279 A1 9/2002 Forbes et al.

FOREIGN PATENT DOCUMENTS

DE 688 777 3/1940
EP 0 347 334 12/1989
EP 0 345 497 9/1992
IT 324 559 2/1935

OTHER PUBLICATIONS

1997 The Car & Locomotive Cyclopedia of American Practices, (Simmons-Boardman Books, Inc., Omaha, Nebraska) pp. 498-499.
1997 The Car & Locomotive Cyclopedia of American Practices, (Simmons-Boardman Books, Inc., Omaha, Nebraska) pp. 672-676.

* cited by examiner

SYMMETRICAL MULTI-UNIT RAILROAD CAR

FIELD OF THE INVENTION

This invention relates to multi-unit rail road cars, and in particular to symmetrical arrangements in such cars.

BACKGROUND OF THE INVENTION

Articulated multi-unit rail road cars typically have at least two railcar units permanently joined to each other end-to-end at an articulation connection. Most commonly, the adjoining railcar units share a truck, with the articulated connector being mounted over the truck center. In a conventional three-unit articulated rail road car, an intermediate, or middle railcar unit, may typically share a truck with each end railcar unit. The ends of the intermediate railcar unit are joined to the respective adjacent ends of the end railcar units by articulated connectors. A typical articulated connector includes a female articulated connector portion, or socket, mounted to one railcar unit; and an opposing mating male articulated connector portion, or member, mounted to the next adjacent railcar unit. Conventionally, the intermediate railcar unit in a three-unit rail road car is provided with an asymmetric arrangement of articulated connector portions, that is, it has a female articulated connector portion at one end and a male articulated connector portion at the opposite end. Correspondingly, the end railcar units have counterpart male or female articulated connector portions, as the case may be. In that style of layout, all female articulated connector portions extend toward the same end of the three-unit rail road car.

In order to control "side sway", or roll, of one railcar unit relative to the next adjacent railcar unit, at each end having an articulated connector each railcar unit has a pair of side-bearing support arms. In one arrangement, at one end of the intermediate railcar unit, a narrow pair of side-bearing arms is nested within an opposing, relatively wider pair of side-bearing arms mounted to the adjacent end railcar unit. The side-bearing arrangement is reversed at the other end of the intermediate railcar unit such that the latter is provided with the wide pair of side-bearing arms and the adjacent end railcar unit has the narrow pair of side-bearing arms.

The ride characteristics in a conventional three-unit rail road car may tend to vary depending on the direction of travel. More specifically, it appears that the car may tend to perform "better" in one direction of travel than in the other, particularly when the car is running over curved portions of track. It has further been noted that the wheels of the shared trucks may tend to be subject to greater lateral forces when the car is travelling in the direction associated with less satisfactory performance. It is thought that in addition to causing uneven wear on the truck wheels, this may also tend to increase the likelihood that the wheels will ride up on the rail, and jump the track.

The propensity of the wheels to ride up on the rail may be considered to be a function of the L/V ratio, where L is the lateral force to which the truck wheels are subject and V is the vertical force carried by the truck wheels. The higher the L/V value, the greater may be the likelihood that the truck wheels may tend to ride against the rail when the car negotiates a curve in the track. Accordingly, lower L/V values for the truck wheels may tend generally to be desirable. However, in a conventional rail road car of the type described above, under certain circumstances, the L/V values for the truck wheels may be significantly greater in one direction than the other. This may tend adversely to affect the stability of the car and may tend to generate undesirable vibration throughout the car structure. This in turn may ultimately lead to crack propagation and failure in the car, and consequently to costly car maintenance and repair. In addition, when travelling over a curved portion of track, the side-bearing arms in some of these cars may be subject to undesirably high forces further encouraging vibration in the car structure.

The difference in dynamic performance of the rail road cars may tend to be more (or less) pronounced depending on variation of the frequency of the input perturbances. That is, performance may tend to be a function of frequency and evaluation of the various alternatives may require optimization over the full range of forcing frequencies associated with in-service operation. It has been noted above that dynamic performance may be "better" in one direction than another. The term "better" needs to be understood in the expected operational life. An arrangement that may provide very good performance at one frequency, may provide very poor performance at another, such that, overall, it may be inferior to another layout that produces moderately good performance across the spectrum. In that context, the assessment of "better", is an overall evaluation performance.

The disadvantages associated with the conventional asymmetric three-unit articulated connector and side bearing arm arrangements noted above may not be restricted to three-unit cars. Other multi-unit articulated rail road cars having a larger number of rail car units may also tend to demonstrate similar dynamic performance phenomena.

Accordingly, in the view of the present inventors, it may be advantageous to construct a multi-unit articulated railroad car having a tendency to exhibit similar ride performance characteristics in both travel directions. Such a car may tend to be less prone to the development of fatigue cracks and may have an extended service life. It would also be desirable to have a multi-unit articulated railroad car in which the forces in the side-bearing arms are reduced to yield improved ride stability of the railroad car.

In a conventional multi-unit articulated rail road car, a number of different sub-assemblies are required to construct any given unit of the car. Manufacturing may be facilitated and made more cost-effective if the number of different sub-assemblies used in a given unit were reduced.

SUMMARY OF THE INVENTION

In an aspect of the invention, there is a multi-unit articulated railroad car comprising an un-even number of rail car units connected in end-to-end fashion by articulated connectors mounted above railroad trucks. The railroad car has a transverse centerline. The articulated connectors is mounted to the railcar units in a symmetrical arrangement relative to the transverse centerline.

In an additional feature of that aspect of the invention, one of the rail car units is a middle rail car unit. Each articulated connector has a male portion and a female portion. The middle rail car unit has two said male portions mounted thereto.

In another feature of that aspect of the invention, one of the rail car units is a middle rail car unit. Each articulated connector has a male part and a female portion. The middle rail car unit has two of said female parties mounted thereto.

In yet another feature, the railroad car has side bearing arms, and the side bearing arms are mounted in a symmetrical arrangement relative to the transverse centerline. In still another feature, one of the railcar units is a middle rail car unit carried between first and second areas of the rail car trucks. The middle rail car has side bearing arms mounted thereto.

The side bearing arms engage bearing surfaces supported on the first and second trucks. The side bearing arms are arranged symmetrically relative to the transverse centerline. In a further still feature, at least one of the rail car units has a well defined therein for accommodating intermodal cargo.

In another aspect of the invention, there is a multi-unit articulated intermodal railroad car comprising first, second and third rail car units carried on a plurality of rail car trucks. The first rail car unit is joined to the second rail car unit at a first articulated connection mounted to a first of the trucks. The second rail car unit is joined to the third rail car unit at a second articulated connection mounted to a second of the trucks. Each articulated connection has a male articulated connector portion associated with the end of one rail car unit and a mating female articulated connector portion associated with the end of an adjacent rail car unit. The second rail car unit has a first end adjacent the first rail car unit and a second end adjacent the third rail car unit. The first and second ends each have one of the male and female articulated connector portions mounted thereto. The articulated connector portion mounted to the first end of the second rail car unit is identical to the articulated connector portion mounted to the second end thereof. The first and third rail car units each have an end adjacent the second rail car unit. The first and third rail car unit ends each have the other of the male and female articulated connector portions mounted thereto for mating with the articulated connector portions of the first and second ends of the second rail car unit. The articulated connector portion mounted to the first rail car unit end is identical to the articulated connector portion mounted to the third rail car unit end.

In an additional feature of that aspect of the invention, the articulated connector portion mounted to each end of the second rail car unit is a female articulated connector portion. The articulated connector portions mounted to the first and third rail car unit ends are male articulated connector portions.

In an another feature, the articulated connector portion mounted to each end of the second rail car unit is a male articulated connector portion. The articulated connector portion mounted to the first and third rail car unit ends are female articulated connector portions.

In an additional feature, the second rail car unit includes a first pair of side bearing arms mounted to the first end thereof and a second pair of side bearing arms mounted to the second end thereof. The side bearing arms of the first pair are identical to the side bearing arms of the second pair. The first rail car unit end has a third pair of side-bearing arms mounted thereto for locating opposite the first pair of side-bearing arms. The third rail car unit end has a fourth pair of side-bearing arms mounted thereto for locating opposite the second pair of side-bearing arms. The side-bearing arms of the fourth pair are identical to the side-bearing arms of the third pair.

In a further additional feature, each side-bearing arm has a proximal end connected to a respective end of a rail car unit and a distal end. The side-bearing arms of the first pair are spaced away from each other a first distance measured center-to-center at the proximal ends thereof. The side-bearing arms of the second pair are spaced away from each other a second distance measured center-to-center at the proximal ends thereof. The second distance is equal to the first distance. The side-bearing arms of the third pair are spaced away from each other a third distance measured center-to-center at the proximal ends thereof. The side-bearing arms of the fourth pair are spaced away from each other a fourth distance measured center-to-center at the proximal ends thereof. The fourth distance is equal to the third distance. In a further still additional feature, the third distance is greater than the first distance.

In an additional feature, the first pair of side-bearing arms is nested within the third pair of side-bearing arms. The second pair of side-bearing arms is nested within the fourth pair of side-bearing arms. In an another additional feature, the first pair of side-bearing arms lies laterally inboard of the third pair of side-bearing arms and the second pair of side-bearing arms lies laterally inboard of the fourth pair of side-bearing arms. In a further additional feature, the side-bearing arms of the first pair extend away from the first end of the second rail car unit in a mutually diverging manner and the side-bearing arms of the third pair extend away from the third rail car unit end in a mutually diverging manner.

In yet another additional feature, the first pair of side-bearing arms lies between the third pair of side-bearing arms and the second pair of side-bearing arms lies between the fourth pair of side-bearing arms. In a further feature, the third distance is less than or equal to about 70 inches. The first distance is at least about 42 inches. In another additional feature, the third distance is 60 inches and the first distance is 42 inches. In still another additional feature, the third distance is 52 inches and the first distance is 48 inches.

In another additional feature, the side-bearing arms of the first pair extend substantially perpendicular to the first end of the second rail car unit. The side-bearing arms of the third pair extend away from the third rail car unit end in a mutually diverging manner.

In another feature, the first distance is greater than the third distance. In an additional feature, the third pair of side-bearing arms is nested within the first pair of side-bearing arms. The fourth pair of side-bearing arms is nested within the second pair of side-bearing arms. In yet another additional feature, the third pair of side-bearing arms lies laterally inboard of the first pair of side-bearing arms. The fourth pair of side-bearing arms lies laterally inboard of the second pair of side-bearing arms. In a further feature, the side-bearing arms of the first pair extend away from the first end of the second rail car unit in a mutually diverging manner. The side-bearing arms of the third pair extend away from the third rail car unit end in a mutually diverging manner.

In another additional feature, the third pair of side-bearing arms lies between the first pair of side-bearing arms. The fourth pair of side-bearing arms lies between the second pair of side-bearing arms. In a further feature, the first distance is less than or equal to about 70 inches and the third distance is at least 42 inches. In still a further feature, the first distance is 60 inches and the third distance is 42 inches. In yet an additional feature, the first distance is 52 inches and the third distance is 48 inches.

In another additional feature, the side-bearing arms of the third pair extend substantially perpendicular to the third rail car unit end. The side-bearing arms of the first pair extend away from the first end of the second rail car unit in a mutually diverging manner.

In yet another additional feature, the first distance is equal to the third distance. In a further feature, the side-bearing arms of the first pair extend substantially perpendicular to the first end of the second rail car unit. The side-bearing arms of the second pair extend substantially perpendicular to the second end of the second rail car unit. The side-bearing arms of the third pair extend substantially perpendicular to the third rail car unit end. The side-bearing arms of the fourth pair extend substantially perpendicular to the fourth rail car unit end. In an additional feature, the distal ends of the side-bearing arms of the first pair are aligned with the distal ends of the third pair of side-bearing arms. The distal ends of the side-bearing arms of the second pair are aligned with the distal ends of the fourth pair of side-bearing arms. In yet another additional feature, the first distance is in the range of about 50 inches to about 70 inches. In still another additional feature, the first distance is 50 inches. In a further feature, the first distance is 70 inches.

In another feature, the side-bearing arms of the first and third pairs are mutually engaging. The side-bearing arms of the first pair has an upwardly facing bearing surface. The side-bearing arms of the third pair has a downwardly facing bearing surface.

In yet another feature, the side-bearing arms of the first and third pairs are mutually engaging. The side-bearing arms of the first pair has a downwardly facing bearing surface. The side-bearing arms of the third pair has an upwardly facing bearing surface.

In an additional feature, each articulated connection is carried at a first height above TOR. The side-bearing arms of each pair are carried at a second height above TOR. In a further feature, the second height is greater than the first height. In yet a further feature, the second height is 37 inches above TOR. In another feature, the second height is 44 inches above TOR. In yet another feature, the second height is substantially equal to the first height.

In yet another aspect of the invention, there is a multi-unit articulated intermodal railroad car comprising first, second, third, fourth and fifth rail car units carried on a plurality of rail car trucks. The first rail car unit is joined to the second rail car unit at a first articulated connection. The second rail car unit is joined to the third rail car unit at a second articulated connection. The third rail car unit is joined to the fourth rail car unit at a third articulated connection. The fourth rail car unit is joined to the fifth rail car unit at a fourth articulated connection. Each articulated connection having a male articulated connector portion associated with the end of a rail car unit and a mating female articulated connector portion associated with the end of an adjacent rail car unit. The first rail car unit has an end adjacent the second rail car unit. The first rail car unit end has one of the male and female articulated connector portions mounted thereto. The fifth rail car unit has an end adjacent the fourth rail car unit. The fifth rail car unit end has one of the male and female articulated connector portions mounted thereto. The articulated connector portion of the fifth rail car unit end is identical to the articulated connector portion of the first rail car unit end. The third rail car unit has a first end adjacent the second rail car unit and a second end adjacent the fourth rail car unit. The first and second ends each have one of the male and female articulated connector portions mounted thereto. The articulated connector portion mounted to the first end of the third rail car unit is identical to the articulated connector portion mounted to the second end thereof.

In an additional feature, the articulated connector portion mounted to each end of the third rail car unit is a female articulated connector portion. In a further feature, the articulated connector portions mounted to the first and fifth rail car unit ends are male articulated connector portions. In still another feature, the articulated connector portions mounted to the first and fifth rail car unit ends are female articulated connector portions.

In another additional feature, the articulated connector portion mounted to each end of the third rail car unit is a male articulated connector portion. In a further feature, the articulated connector portions mounted to the first and fifth rail car unit ends are female articulated connector portions. In another feature, the articulated connector portions mounted to the first and fifth rail car unit ends are male articulated connector portions.

BRIEF DESCRIPTION OF THE DRAWINGS

The present invention may be further understood by reference to the following detailed description of the embodiments of the invention, taken in conjunction with the accompanying drawings, in which.

DETAILED DESCRIPTION OF EMBODIMENTS OF THE INVENTION

Figure 1:
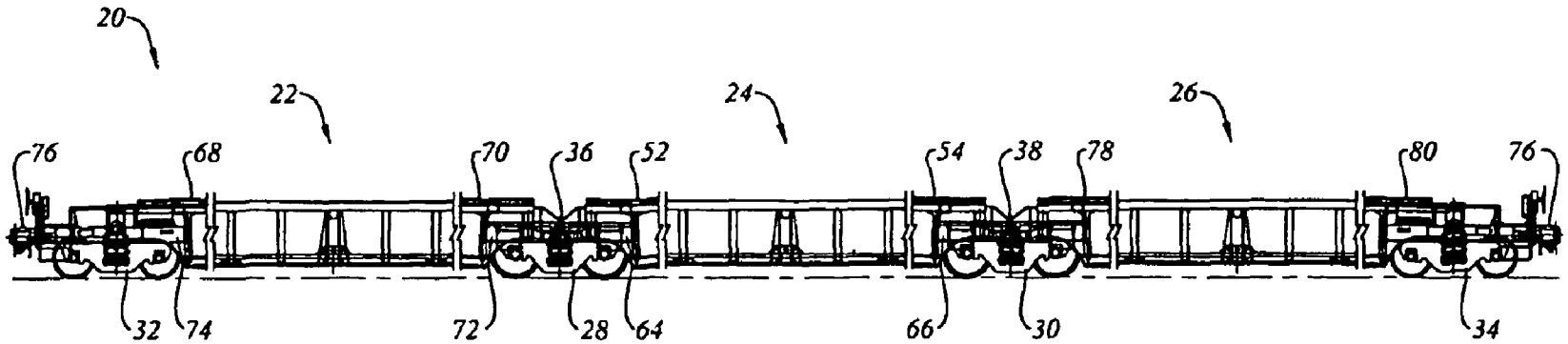
FIG. 1 is a side view of an example of a preferred embodiment of a three-unit articulated rail road car according to an aspect of the present invention, the illustrations of the units being foreshortened by the omission of sections as indicated.

The description which follows, and the embodiments described therein, are provided by way of illustration of an example, or examples of particular embodiments of principles and aspects of the present invention. These examples are provided for the purposes of explanation, and not of limitation, of those principles and of the invention. In the description that follows, like parts are marked throughout the specification and the drawings with the same respective reference numerals.

In terms of general orientation and directional nomenclature, for each of the rail road cars described herein, the longitudinal direction is defined as being coincident with the rolling direction of the car, or car unit, when located on tangent (that is, straight) track. In the case of a car having a center sill, whether a through center sill or stub center sill, the longitudinal direction is parallel to the center sill, and parallel to the side sills, if any. Unless otherwise noted, vertical, upward and downward, are terms that use top of rail TOR as a datum. Unless otherwise noted, the term lateral, or laterally outboard, or transverse refers to a cross-wise distance or orientation relative to the longitudinal centerline of the rail road car, or car unit, indicated as CL-Rail Car. The term "longitudinally inboard", or "longitudinally outboard" is a lengthwise distance taken relative to a mid-span lateral section of the car, or car unit.

Three-Unit Articulated Rail Road Car

Figure 2:
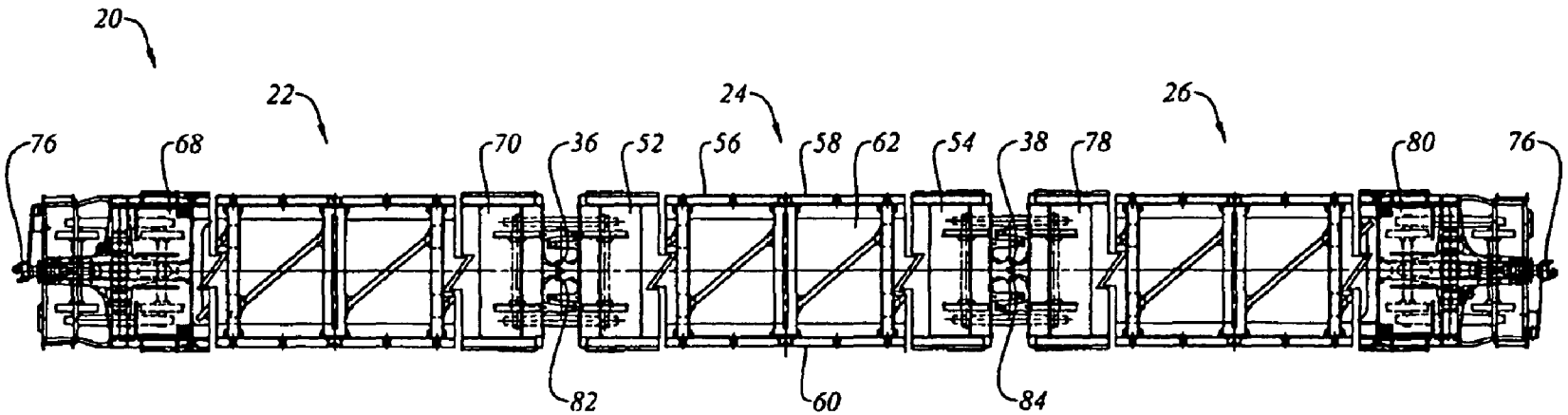
FIG. 2 is a top view of the three-unit articulated rail road car of FIG. 1 showing an intermediate unit of the rail road car having a female articulated connector portion at either end thereof.

A three-unit articulated rail road car is indicated in FIGS. 1 and 2 generally as 20. Car 20 is preferably a freight car in the nature of an intermodal freight car, such as a COFC or TOFC flat car, or a spine car, or most preferably a well car, but could be another type of rail road freight car, such as an auto-rack car, a gondola car, a center-beam car, a box car, or other type of rail road car. It has a first rail car end unit 22, an intermediate, or middle, rail car unit 24 and a second rail car end unit 26, arranged end-to-end. Car 20 is carried on shared trucks 28 and 30, and end car trucks 32 and 34. End units 22 and 26 are each joined to intermediate unit 24 at an articulated connection 36 or 38, as the case may be. Articulated connections 36 and 38 are mounted directly over shared trucks 28 and 30, respectively. That is, the centre line of the articulated connection is co-incident with the truck centre.

Figure 3:
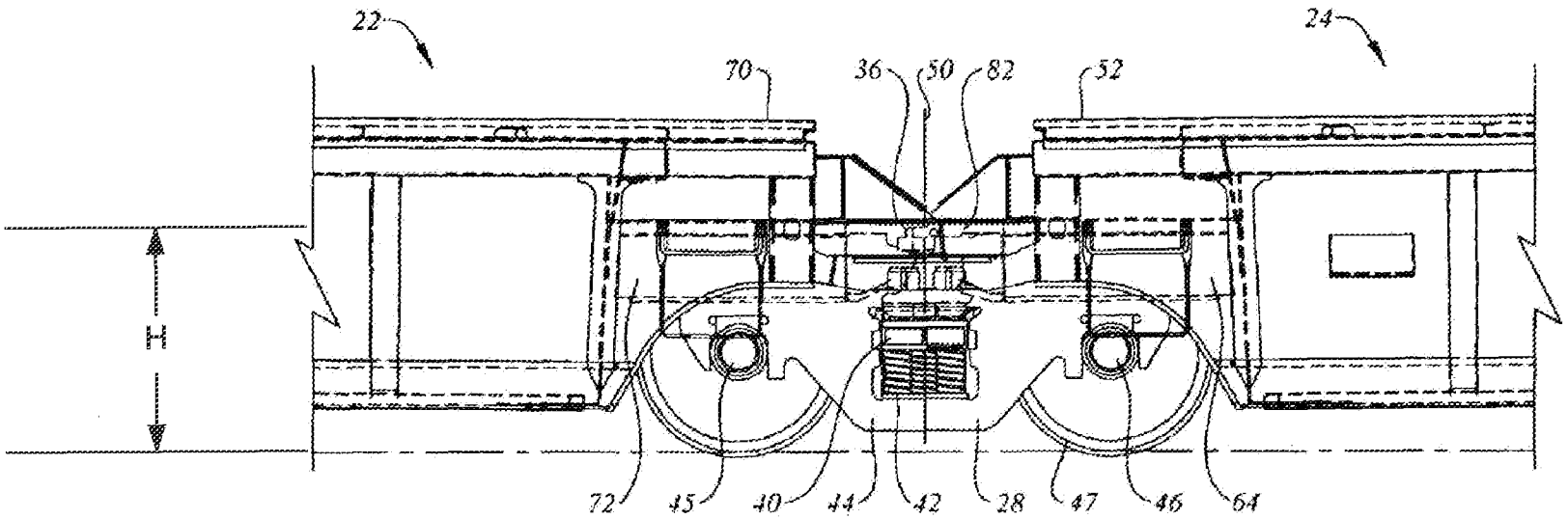
FIG. 3 is an enlarged side view of a portion of the three-unit articulated rail road car of FIG. 1, showing an articulated connection between an intermediate unit and an adjacent end unit.

Referring to FIG. 3, each shared truck 28 and 30 is a double axle, swivelling, three piece truck of customary North American layout and construction. Truck 28 (or 30) includes a horizontal, transversely oriented truck bolster 40 supported on springs 42, and a pair of side frames 44 mounted to the laterally outboard ends of truck bolster 40. Side frames 44 carry a pair of longitudinally spaced apart axles 45 and 46 upon which are mounted wheel pairs 47. Located atop truck bolster 40 is a truck center plate 48. Truck center plate 48 supports the articulated connection 36 (or 38) associated with two adjacent rail car units. Truck center plate 48 permits shared truck 28 or 30 to pivot, or swivel, about a generally vertical truck turning axis 50 namely the truck centre (as shown in FIG. 3) to follow the rails on the track. While in the embodiment of FIG. 3 shared trucks 28 and 30 are double axle trucks, a person skilled in the art will appreciate that other types of trucks, such as three axle trucks, could be used instead.

Intermediate unit 24 has a first end structure 52 supported by shared truck 28 and a second end structure 54 supported by shared truck 30. Intermediate unit 24 includes a body 56 having a pair of deep, spaced apart side beams 58 and 60 extending between, and mounted to, end structures 52 and 54. A well 62 for receiving one or more cargo containers is defined longitudinally between end structures 52 and 54. Side beams 58 and 60 define the sides of well 62. End structure 52 has a stub sill 64 mounted over shared truck 28 and extending to articulation connection 36. Similarly, at the other end of intermediate unit 24, a stub sill 66 is mounted over shared truck 30 and extends to articulated connection 38.

End unit 22 has substantially the same structure as intermediate unit 24 described above, but has an articulated connection at one end only. More specifically, end unit 22 has a first end structure 68 supported by end car truck 32 and a second end structure 70 supported by shared truck 28. Each end structure 68, 70 has a stub sill 72, 74. Stub sill 72 is mounted above shared truck 28 and extends to articulated connection 36. At its distal end stub sill 74 has a standard releasable coupler 76 mounted thereto to allow end unit 22 to be coupled and uncoupled when forming a new train consist. Coupler 76 is of the type to allow interchangeable service with rail road freight cars in general service in North America. End unit 26 is substantially the same as end unit 22 described above. As shown in FIG. 1, its first and second end structures are identified as 78 and 80, respectively. First end structure 78 is supported on shared truck 30. Second end structure 80 has a standard releasable coupler 76 mounted thereto.

Figure 5:
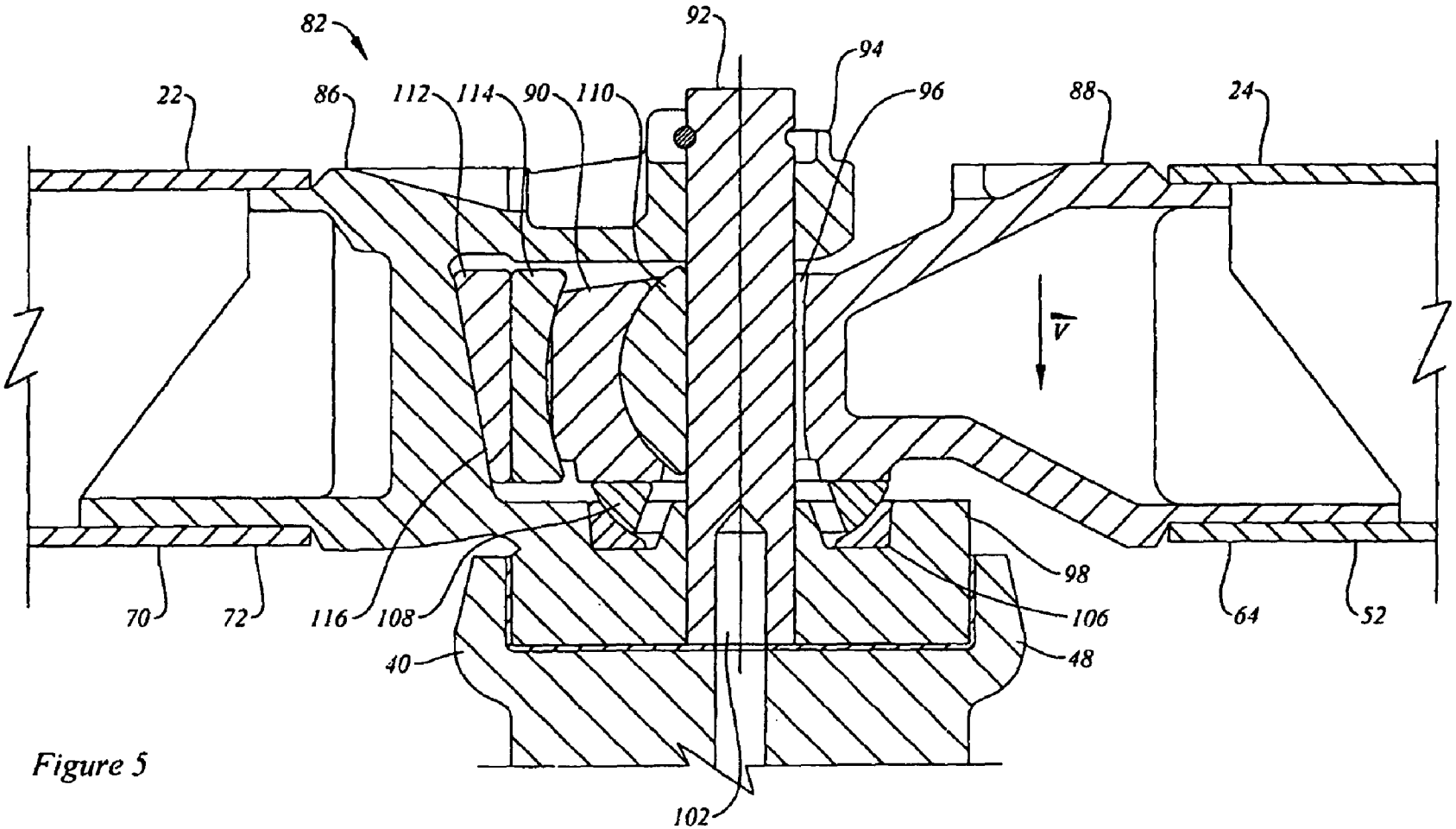
FIG. 5 is a cross-section of an illustrative articulated connector suitable for use with the three-unit articulated rail road car of FIG. 1, with the underlying shared truck thereof omitted from the illustration for clarity.

Articulated connections 36 and 38 (and the other articulated connections noted herein) are preferably steel articulated connectors, indicated generally in FIG. 2 as 82 and 84, respectively, similar to those commonly available from manufacturers such as Westinghouse Air Brake (WABCO) of Wilmerding Pa., or American Steel Foundries (ASF), also known as Amsted Industries Inc., of Chicago Ill. The general form of one type of articulated connector (with a vertical pin) is shown, for example, in U.S. Pat. No. 4,336,758 of Radwill, issued Jun. 29, 1982. In general, this kind of permanent, articulated connection has a female articulated connector portion, in the nature of a female socket 86 mounted to the end structure of one articulated rail car unit (in the case of articulated connector 82, end structure 52 of intermediate unit 24), and a male articulated connector portion or member 88 mounted to the end structure of an adjacent rail car unit, (in the case of articulated connector 82, end structure 70 of end unit 22), as shown in FIGS. 3 and 5. Female socket 86 of articulated connector 82 or 84 rests in, and is supported by, truck center plate 48 of shared truck 28 or 30, as the case may be.

A conceptual illustration of articulated connector 82 (and 84) is shown in cross-section in FIG. 5. FIG. 5 is not necessarily to scale, and may not show all of the features of articulated connector 82 or 84 in detail. Male member 88 has an extension, or nose, 90 that seats in female socket 86. A main pivot pin 92 extends through a bore defined in top plate 94 of female socket 86, through a bore, or passage 96 in male member 88, and through the base plate 98 of female socket 86. Pivot pin 92 is nominally vertical. That is, on straight, level track pin 92 is vertical. Pivot pin 92 acts as a locking pin to prevent female socket 86 and male member 88 from separating from each other. The mated portions 86 and 88 of the articulated connector are joined to shared truck 28 or 30, by way of a pin (not shown) which extends from blind bore 102 of pin 92 to seat in a central bore (not shown) defined in truck center plate 48. With specific reference to articulated connector 82, the truck center plate 48 of shared truck 28, supports the portion of the weight of intermediate unit 24 that is transferred through female socket 86 mounted thereto, and the portion of the weight of end unit 22 that is transferred through male member 88 associated therewith.

Male member 88 has three rotational degrees of freedom relative to female socket 86 to accommodate curvature, dips and rises in the track over which the rail road car 20 may travel. First, it can yaw about the main pivot axis, as when the car units negotiate a bend or switch. Second, it can pitch about a transverse horizontal axis, as when the car units change slope at the trough of a valley or the crest of a grade. Third, the car units can roll relative to each other, as when entering or leaving super-elevated cross-level track, (that is, banked track). It is not intended that male member 88 have any translational degrees of freedom relative to female socket 86, such that a vertically downward shear load can be transferred from male member 88 into female socket 86, with little or no longitudinal or lateral play. To permit these motions, female socket 86 has spherical seat 106 having an upwardly facing bearing surface describing a portion of a spherical surface. Another mating spherical annular member 108 sits atop seat 106, and has a mating, downwardly facing, bearing surface describing a portion of a sphere such that a spherical bearing surface interface is created. Member 108 also has an upwardly facing surface upon which male member 88 sits. An insert 110 has a cylindrical interface lying against pin 92, and a spherical surface that engages a mating spherical surface of passage 96 lying on the inside face of nose 90. A wedge 112 and wear plate 114 are located between nose 90 and the inner wall, or groin, 116, of female socket 86. Wear plate 114 has a vertical face bearing against wedge 112, and a spherical face bearing against a mating external spherical face of nose 90. Wedge 112 bears against wear plate 114, as noted, and also has a tapered face bearing against a corresponding tapered face of groin 116. The tapers are formed such that as wear occurs, gravity will tend to urge wedge 112 downwardly, tending to cause articulated connector 82 or 84 to be longitudinally slackless.

While in the preferred embodiment, articulated connectors 82 and 84 are of the type in which the main pin is nominally vertical, a person skilled in the art will appreciate that other types of articulated connectors may be used. For instance, articulated connectors in which the main pin is nominally horizontal such as shown in U.S. Pat. No. 5,271,571 of Daugherty, Jr., could also be used.

In the preferred embodiment shown in FIGS. 2 and 3, articulated connection 36 is formed with the female socket 86 of articulated connector 82 being mounted to intermediate unit 24 and male member 88 being mounted to end unit 22. Articulated connected 38 is configured in like fashion. Female socket 86 of articulated connector 82 is mounted to intermediate unit 24 and male member 88 is attached to end unit 26. In this way, end structures 52 and 54 of intermediate unit 24 possess identical female articulated connector portions 86. Stated another way, the articulated connector portions of intermediate unit 24 are symmetrical about the mid-span centerline of intermediate unit 24 (indicated in FIG. 2 as 'CL-Transverse'). Correspondingly, the articulated connector portions associated with end units 22 and 26 are mirror images one of the other.

While in the preferred embodiment intermediate unit 24 of rail road car 20 is provided with a pair of identical female articulated connector portions 86, symmetry in the articulated connector arrangement may be achieved differently. In an alternative embodiment shown in FIG. 6, a three-unit rail road car 118 has a middle or intermediate unit 120 and first and second end units 122 and 124, respectively. Middle unit 120 has identical male articulated connector portions 88 mounted to either end for mating with female articulated connector portions 86 associated with the adjacent ends of each of end units 122 and 124. As in the preferred embodiment of FIGS. 4*a* and 4*b*, the arrangement of articulated connectors about the mid-span centerline of the intermediate unit (in this case, middle unit 120) is symmetrical.

In the embodiments described, the symmetrical arrangement of articulated connector portions on intermediate units 24 and 120 may tend to avoid disadvantages associated with the asymmetric arrangements of articulated connector portions. More specifically, the dynamic performance of rail road cars 20 and 118 on the track may tend to be improved generally. The stability of intermediate units 24 and 120 may tend to be enhanced. Moreover, rail road cars 20 and 118 may tend to exhibit similar ride performance characteristics in both directions of travel with comparable L/V values for the truck wheels 47.

Figure 6:
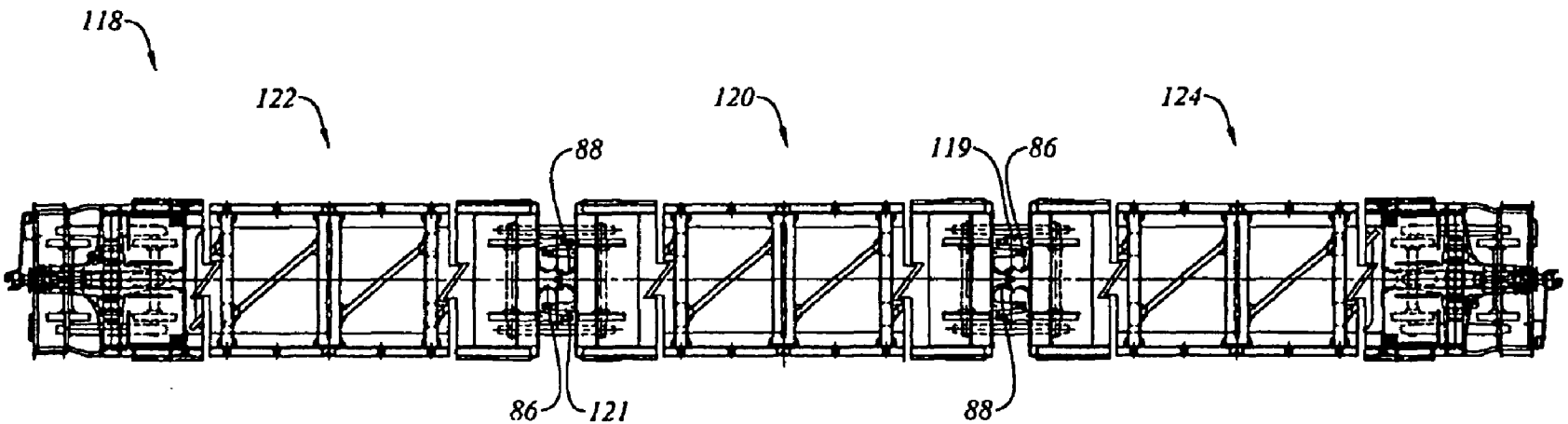
FIG. 6 is a top view of an alternate embodiment of three-unit articulated rail road car to that of FIG. 2 showing an intermediate unit of the rail road car having a male articulated connector portion at either end thereof.

Arranging the articulated connector portions as shown in the embodiments of FIGS. 2 and 6 may also tend to yield efficiencies in manufacturing, thereby reducing costs. More specifically, by providing intermediate unit 24 and 120 with identical articulated connector portions the number of different sub-assemblies required to fabricate these units is reduced. Furthermore, since in the embodiments of FIGS. 2 and 6, both end units 22 and 26, and 122 and 124 have identical articulated connector portions, fabrication of one end unit, for instance end unit 22, is generally the same as that of the other, for instance, end unit 26. In a conventional three-unit rail road car, by reason of the asymmetric arrangement of articulated connector portions, different production steps may be required to fabricate the opposed end units—the one end unit being fabricated with a female articulated connector portion and the other end unit having a male articulated connector portion.

Figure 4A:
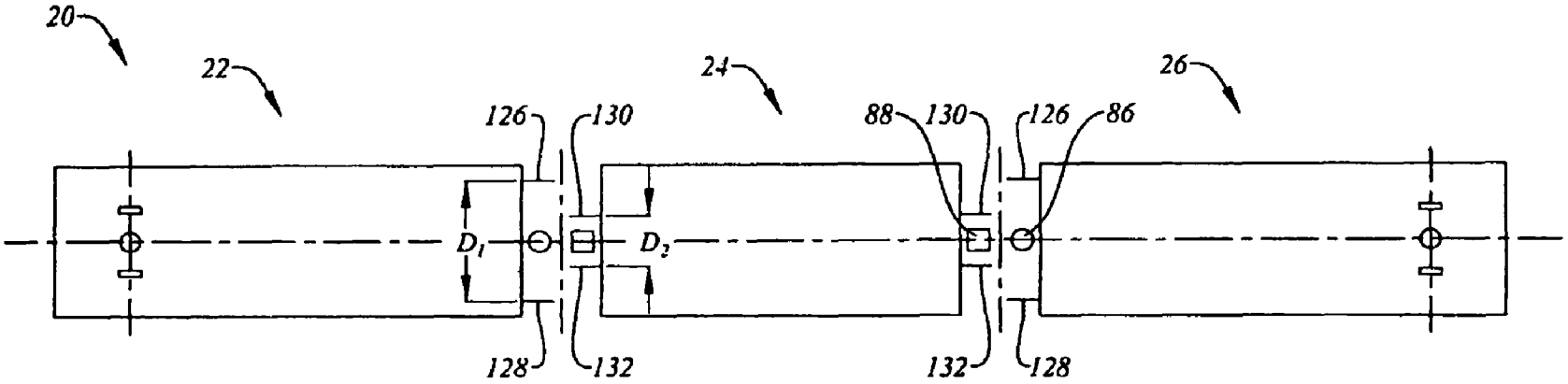
FIG. 4*a* is a schematic top view of the three-unit articulated rail road car of FIG. 2.

In the embodiments shown in FIGS. 2 and 6, the extent of "side sway" or roll of one railcar unit relative to the next adjacent railcar unit is controlled by a pair of longitudinally extending, side-bearing support arms associated with each railcar unit. While the arrangement of side-bearing arms in rail road car 20 is described below with reference to adjacent units 22 and 24, it is understood that this description applies as well to the arrangement of side-bearing arms of adjacent units 26 and 24, the latter arrangement being identical to the former arrangement. Accordingly, each end structure 52, 54 of intermediate unit 24 has an identical arrangement of side-bearing arms and the side-bearing arms of end units 22 and 26 are identical to each other as shown in FIG. 4*a*. For reasons similar to those explained above in connection with the use of a symmetrical arrangement of articulated connector portions, employing a symmetrical arrangement of side-bearing arms may tend to be cost-effective.

Figure 4B:
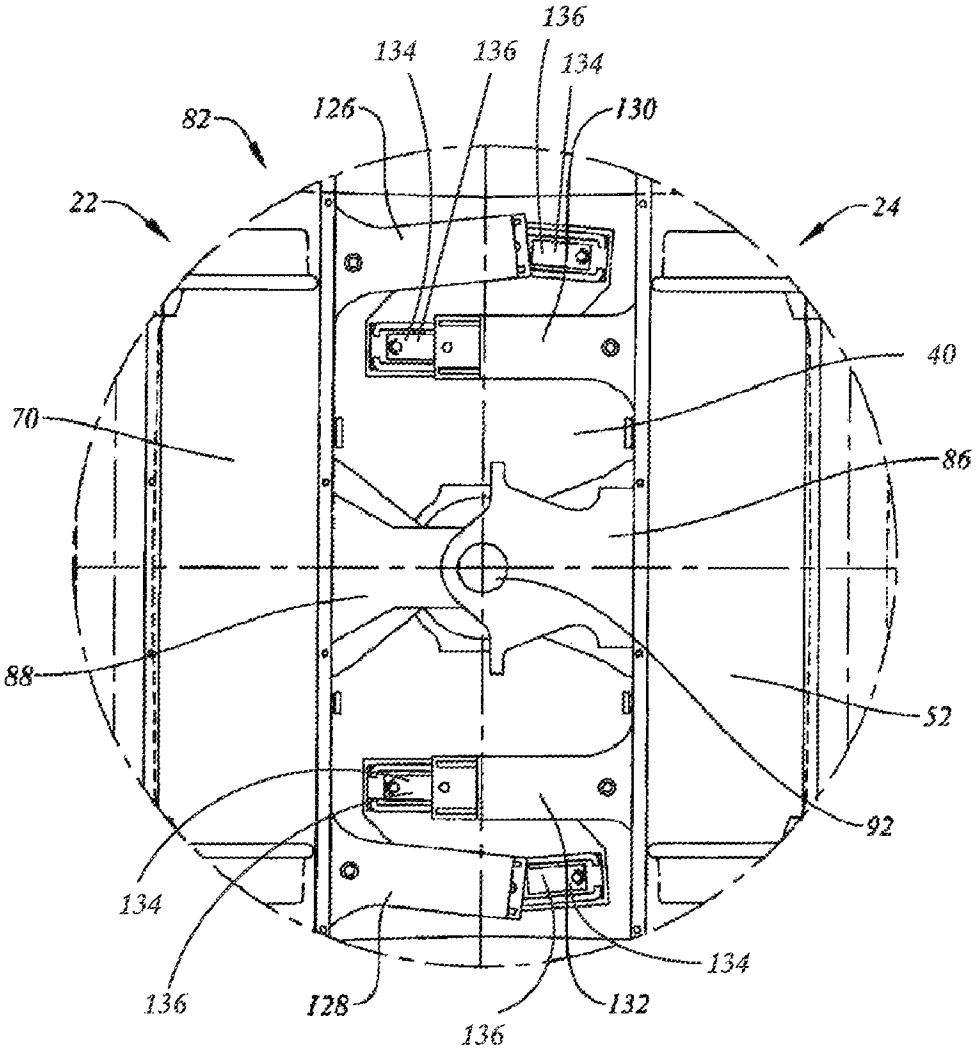
FIG. 4*b* is a top view of the portion of the three-unit articulated rail road car of FIG. 3 showing a pair of side bearing arms of the intermediate unit nested within a pair of side bearing arms of an adjacent end unit.

With reference to FIGS. 4*a* and 4*b*, end unit 22 has a pair of side-bearing support arms 126 and 128 mounted to end structure 70. Nested within, (that is, bracketed by) and lying laterally inboard of, side-bearing arms 126 and 128 is an opposing pair of side-bearing arms 130 and 132 associated with intermediate unit 24. Each side-bearing arm 126 and 128 is spaced laterally away from, and splayed slightly outwardly of, male portion 88 of articulated connector 36. Side-bearing arms 126 and 128 are laterally spaced from each other a distance $D_1$ measured center-to-center at the proximal ends of the side-bearing arms. Side bearing arms 130 and 132 extend substantially perpendicular of end structure 52 and are laterally spaced from each other a distance $D_2$. Distance $D_2$ is the distance measured center-to center at the proximal ends of the side-bearing arms. In this embodiment, distance $D_1$ is greater than distance $D_2$. In the preferred embodiment of FIGS. 4*a* and 4*b*, distance $D_1$ is 60 inches. However, $D_1$ may be and is advantageously between 56 and 64 inches. Distance $D_2$ is at least about 42 inches. In the preferred embodiment shown in FIGS. 4*a* and 4*b*, and subject to the value of $D_1$, Distance $D_2$ may be in the range of 36 to 46 inches, and is preferably about 42 inches. It is possible to modify the spacing of each pair of side-bearing arms while still maintaining the nested relationship between the wide pair of side-bearing arms 126 and 128 and the relatively narrower pair of side-bearing arms 130 and 132. For instance, in one alternative configuration, $D_1$ may be about 52 inches and $D_2$ may be about 48 inches. However, the range of values for distances $D_1$ and $D_2$ is constrained by certain design parameters, such as, the overall width of the rail car unit and clearance from the articulated connector.

Each side-bearing arm 126, 128, 130 and 132 is supported by a respective side bearing interface 134 in the nature of a local bearing pedestal having a bearing surface mounted atop truck bolster 40 on each side of truck center plate 48. A side bearing 136 mounted beneath each side-bearing arm 126, 128, 130 and 132 permits a portion of the weight of intermediate unit 22 or 24, as the case may be, to be transferred from the given side-bearing arm through side bearing 136 and side bearing interface 134, to shared truck 28. In addition, side bearings 136 tend to lessen resistance to the movement of the side-bearing arms relative to side bearing interface 134. Side bearings 136 may be constant contact side bearings with or without rollers. However, preferably, side bearings 136 are 5000XT-SSB extended travel, constant contact, roller-less, side bearings manufactured by and available from A. Stucki Company of Pittsburgh, Pa. The use of these side bearings may tend to reduce the forces to which the side-bearing arms are subjected and may tend to contribute to a reduction in the L/V values of the truck wheels.

In FIG. 3, side-bearing arms 126, 128, 130 and 132 are shown mounted at a height H with their respective side bearing interfaces 134 lying slightly above the horizontal plane that (when the car units are sitting on straight, level track) passes through the center of curvature of the spherical surfaces of the articulated connector. In the preferred embodiment, H is approximately 37 inches above TOR. However, it will be appreciated that the bearing interfaces of the side-bearing arms may be carried at a different height in the range of 36 to 48, or more inches above TOR. In one embodiment, the height H is about 44 inches above TOR.

It has been shown that the forces generated in the side-bearing arms of a three-unit railroad car provided with a symmetrical arrangement of articulated connector portions, tend to be smaller than the forces acting on the side-bearing arms of conventional three-unit railroad cars employing asymmetric articulated connection arrangements. This reduction of the forces in the side-bearing arms may tend to reduce vibration in the car and in so doing may tend to discourage fatigue failure and extend the service life of the car.

Forces in the side-bearing arms may also tend to be reduced by having the wide pair of side-bearing arms associated with a rail car unit having a male articulated connector portion and correspondingly, the opposing, relatively narrower, pair of side-bearing arms associated with an adjacent rail car unit having a female articulated connector portion. A further advantage of this arrangement is that it may tend to contribute to a reduction in L/V values for the truck wheels. While in the preferred embodiment of FIGS. 4*a* and 4*b*, these advantages may be realised by having the wide pair of side-bearing arms associated with end unit 22, it will be appreciated that different arrangements may be used. In the alternative embodiment shown in FIG. 6, the wide pair of side-bearing arms 119 is mounted to intermediate unit 120 which has male articulated connector portion 88. In that embodiment, end unit 122 has female articulated connector portion 86, and the relatively, narrower pair of side-bearing arms 121.

Figure 7A:
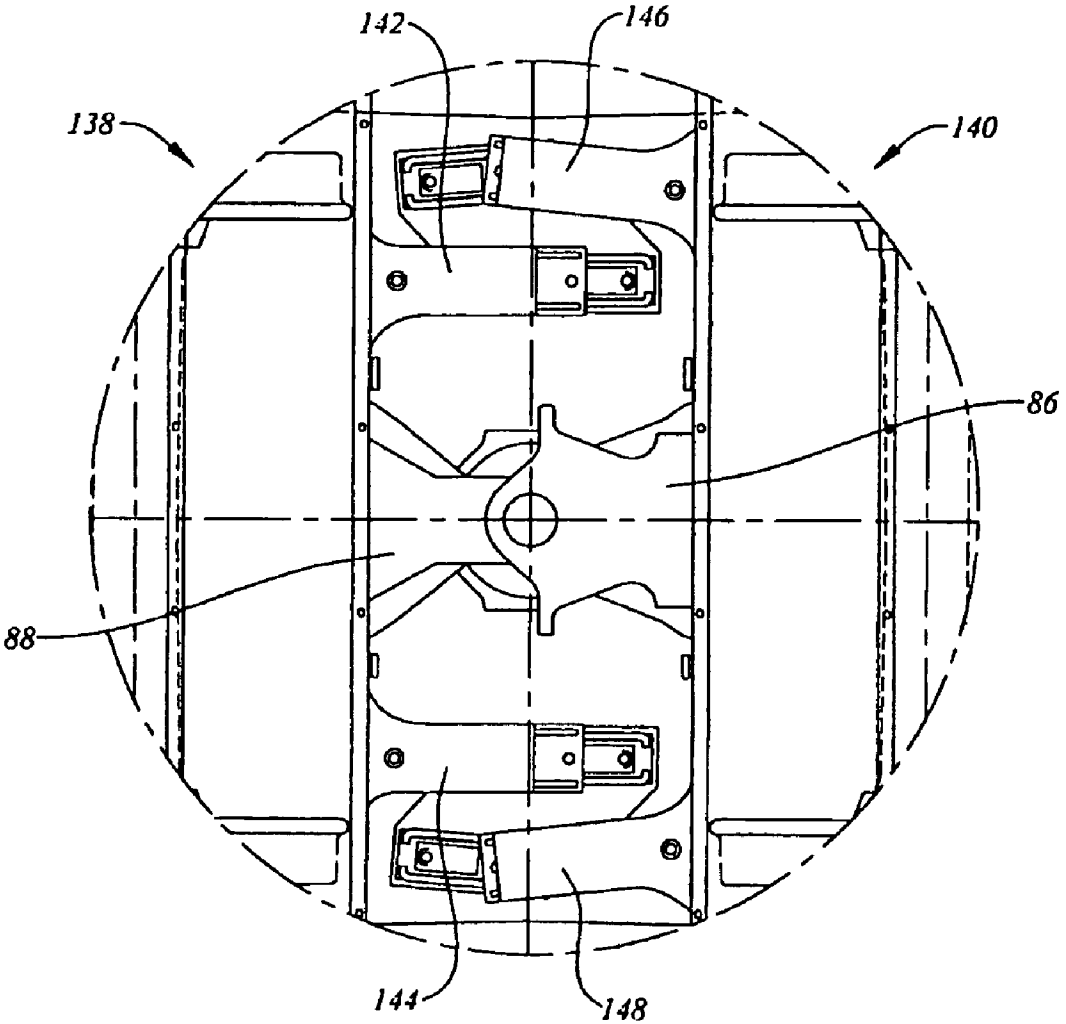
FIG. 7*a* is a top view of a portion of a three-unit articulated rail road car showing a first alternative arrangement of side bearing arms to that shown in FIG. 4*a;*

While it is preferred that the wide pair of side-bearing arms be mounted to a rail car unit having a male articulated connector portion and the relatively narrower pair of side-bearing arms mounted to an adjacent rail car unit having a female articulated connector portion, the arrangement of the wide pair and the narrow pair of side-bearing arms may be reversed. FIG. 7*a*, shows two adjacent railcar units 138 and 140 of a three-unit articulated railroad car. Railcar unit 138 is an end unit generally similar to end unit 22 and railcar unit 140 is an intermediate unit generally similar to intermediate unit 24. In this embodiment, a narrow pair of side-bearing arms 142 and 144 is mounted to the end of end unit 138 also having male articulated connector portion 88 mounted thereto. A pair of relatively wider side-bearing arms 146 and 148 is mounted to the end of intermediate unit 140 also having female articulated connector portion 86 mounted thereto. Side-bearing arms 142 and 144 are nested within, that is, lie between, side-bearing arms 146 and 148. The lateral spacing of the side-bearing arms 146 and 148 (measured center-to center at the proximal ends thereof) may be as great as 70 inches. The lateral spacing of side-bearing arms 142 and 144 (measured center-to center at the proximal ends thereof) is at least 42 inches. In this embodiment, the wide side-bearing arms 146 and 148 are associated with the railcar unit (in this case, intermediate unit 140) having the female articulated connector portion 86 instead of the male articulated connector portion 88.

Figure 7B:
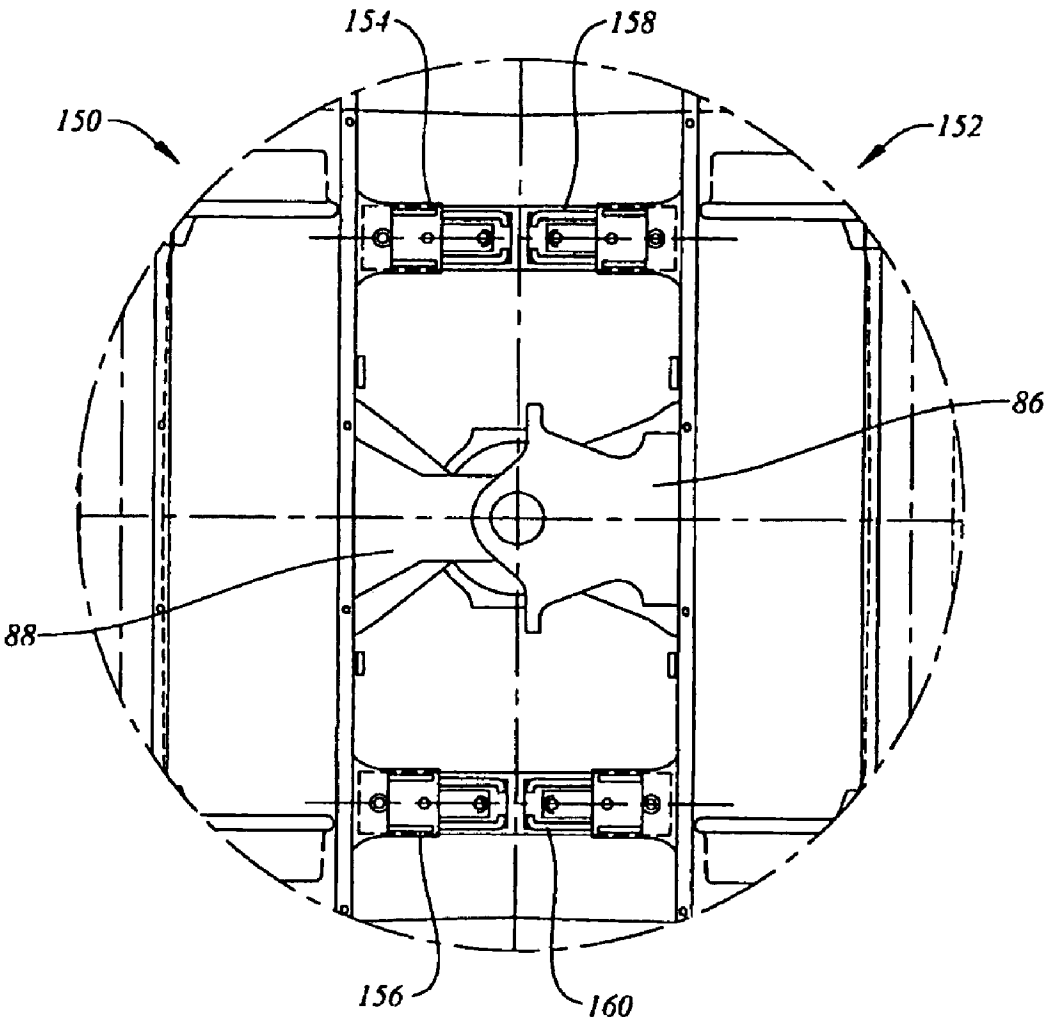
FIG. 7*b* is a top view of a portion of a three-unit articulated rail road car showing a second alternative arrangement of side bearing arms to that shown in FIG. 4*a;*

In the embodiments shown and described above, the opposed pairs of side-bearing arms are in a nested arrangement. However, other alternative side-bearing arm arrangements may also be used. For instance, it is possible to have opposed pairs of equally laterally spaced, side-bearing arms mounted on the adjacent ends of the railcar units. FIG. 7*b* shows two adjacent railcar units 150 and 152 of a three-unit articulated railroad car. Railcar unit 150 is an end unit generally similar to end unit 22, and railcar unit 152 is an intermediate unit generally similar to intermediate unit 24. The adjacent ends of railcar units 150 and 152 each have a pair of side-bearing arms 154, 156 and 158, 160, respectively. Each pair of side-bearing arm 154, 156 and 158, 160 is mounted to extend substantially perpendicular to its respective rail car unit end. As shown in FIG. 7*b*, the lateral spacing of side-bearing arms 154 and 156 is the same as that between side-bearing arms 158 and 160 such that the distal ends of the former pair of side-bearing arms are longitudinally aligned with the distal ends of the latter pair of side-bearing arms. The lateral spacing side-bearing arms (measured center-to center at the proximal ends thereof) may be in the range of about 50 inches to about 70 inches. In the embodiment of FIG. 7*b*, the lateral spacing is 50 inches.

Figure 7C:
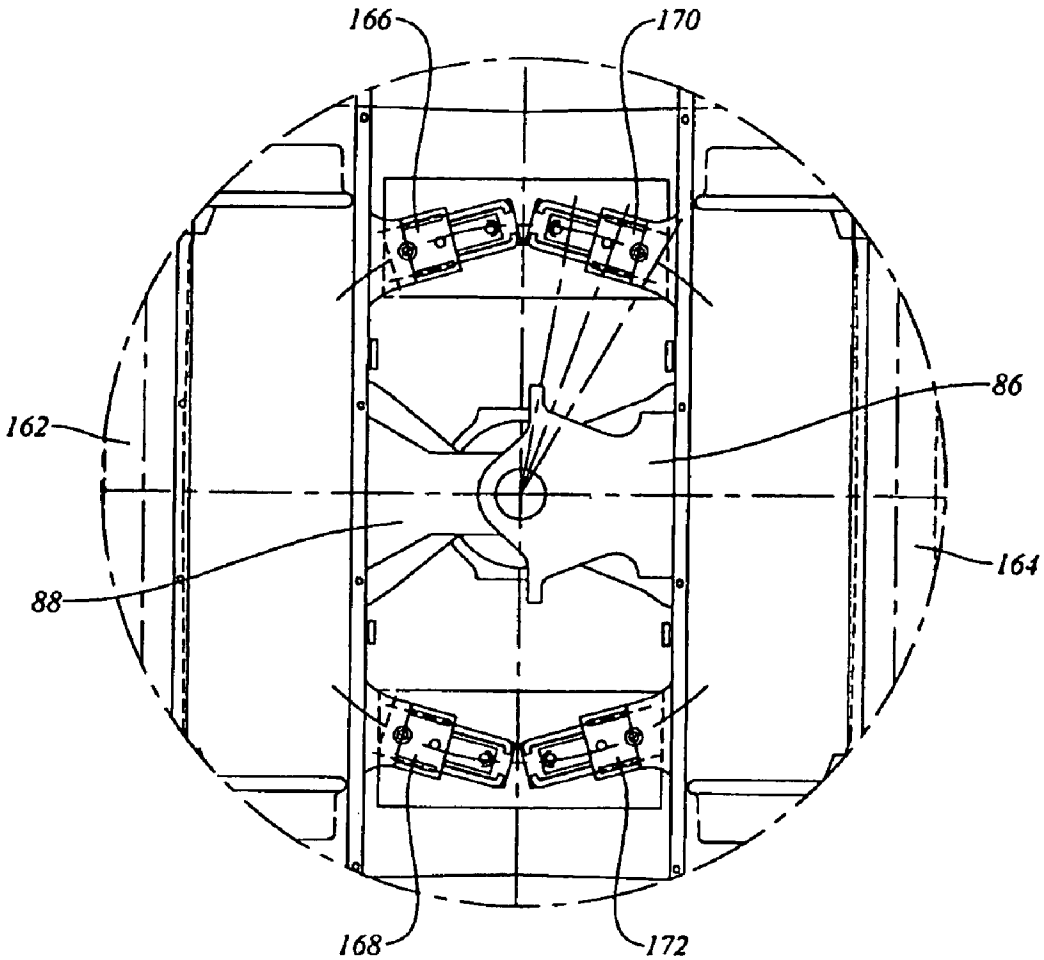
FIG. 7*c* is a top view of a portion of a three-unit articulated rail road car showing a third alternative arrangement of side bearing arms to that shown in FIG. 4*a;*
Figure 7D:
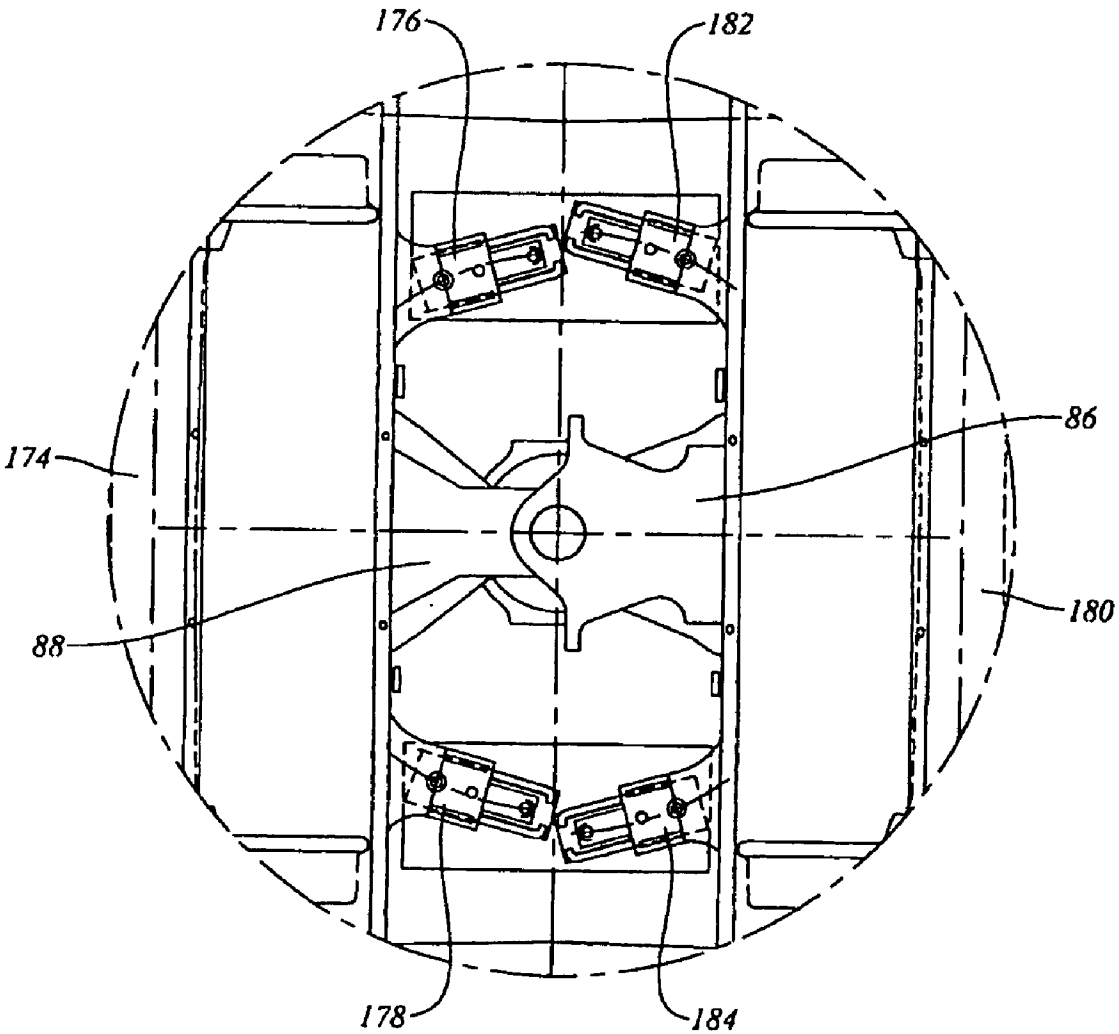
FIG. 7*d* is a top view of a portion of a three-unit articulated rail road car showing a fourth alternative arrangement of side bearing arms to that shown in FIG. 4*a;*

In an another alternative arrangement of side-bearing arms, opposing pairs of equally laterally spaced, diverging side-bearing arms may be employed. Referring to FIG. 7*c*, adjacent railcar units 162 and 164, generally similar to units 22 and 24, respectively, each have a pair of side-bearing arms 166, 168 and 170, 172. Side-bearing arms 166, 168 are outwardly splayed (i.e. diverge from each other). Side-bearing arms 170 and 172 are similarly configured. In this embodiment, the distal ends of diverging side-bearing arms 166 and 168 are longitudinally aligned with the distal ends of the opposing, diverging side-bearing arms 170 and 172. In a modification of this alternative embodiment, a pair of diverging side bearing-arms may be arranged in laterally staggered relation to an opposing pair of diverging bearing-arms. FIG. 7*d*, shows a railcar unit 174 having a pair of diverging side-bearing arms 176 and 178 and an adjacent railcar unit 180 having an opposing pair of diverging side-bearing arms 182 and 184. The lateral spacing between side-bearing arms 176 and 178 (as measured between the proximal ends thereof) is slightly less than the lateral spacing between side-bearing arms 182 and 184 such that the distal ends of side-bearing arms 176 and 178 are staggered or offset laterally inboard from the distal ends of the side-bearing arms 182 and 184.

Figure 7E:
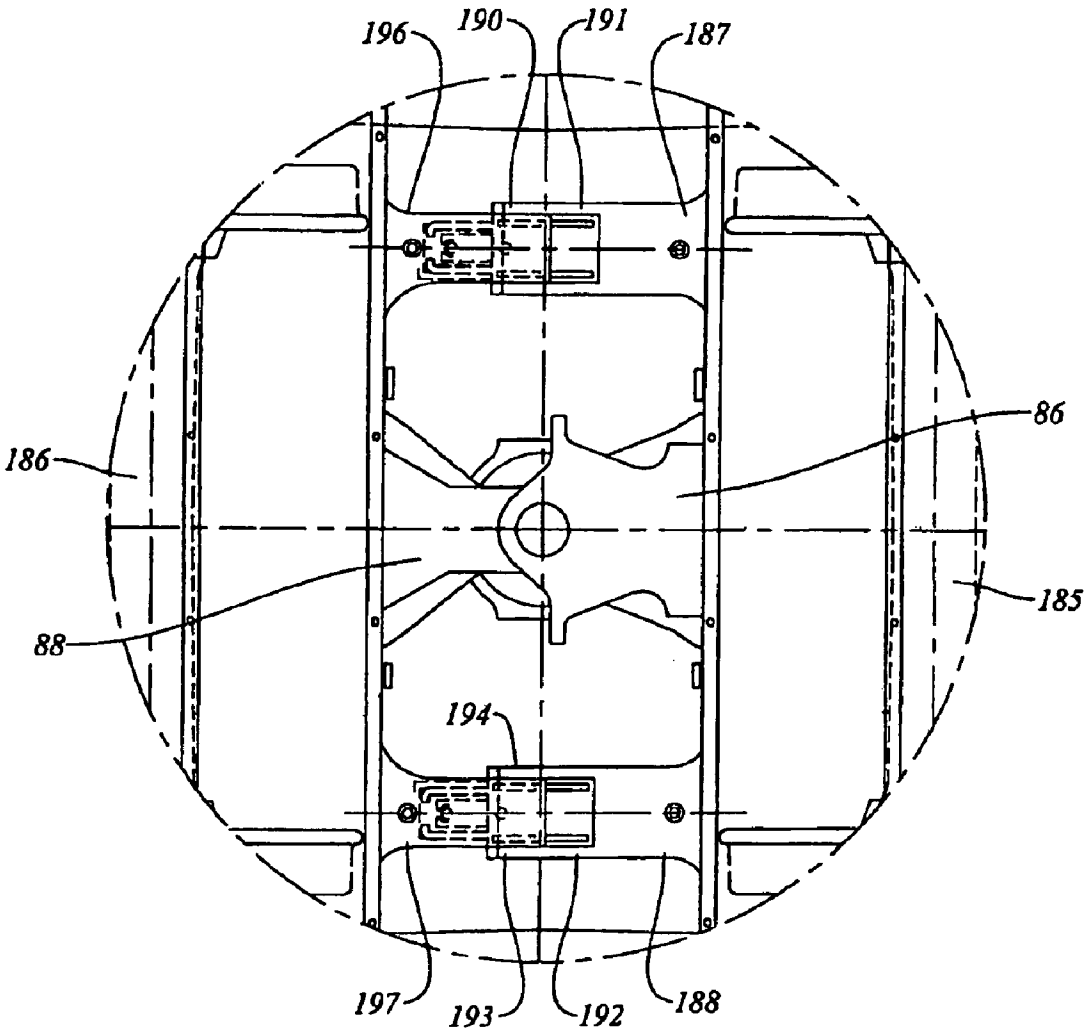
FIG. 7*e* is a top view of a portion of a three-unit articulated rail road car showing a fifth alternative arrangement of side bearing arms to that shown in FIG. 4*a;*
Figure 7F:
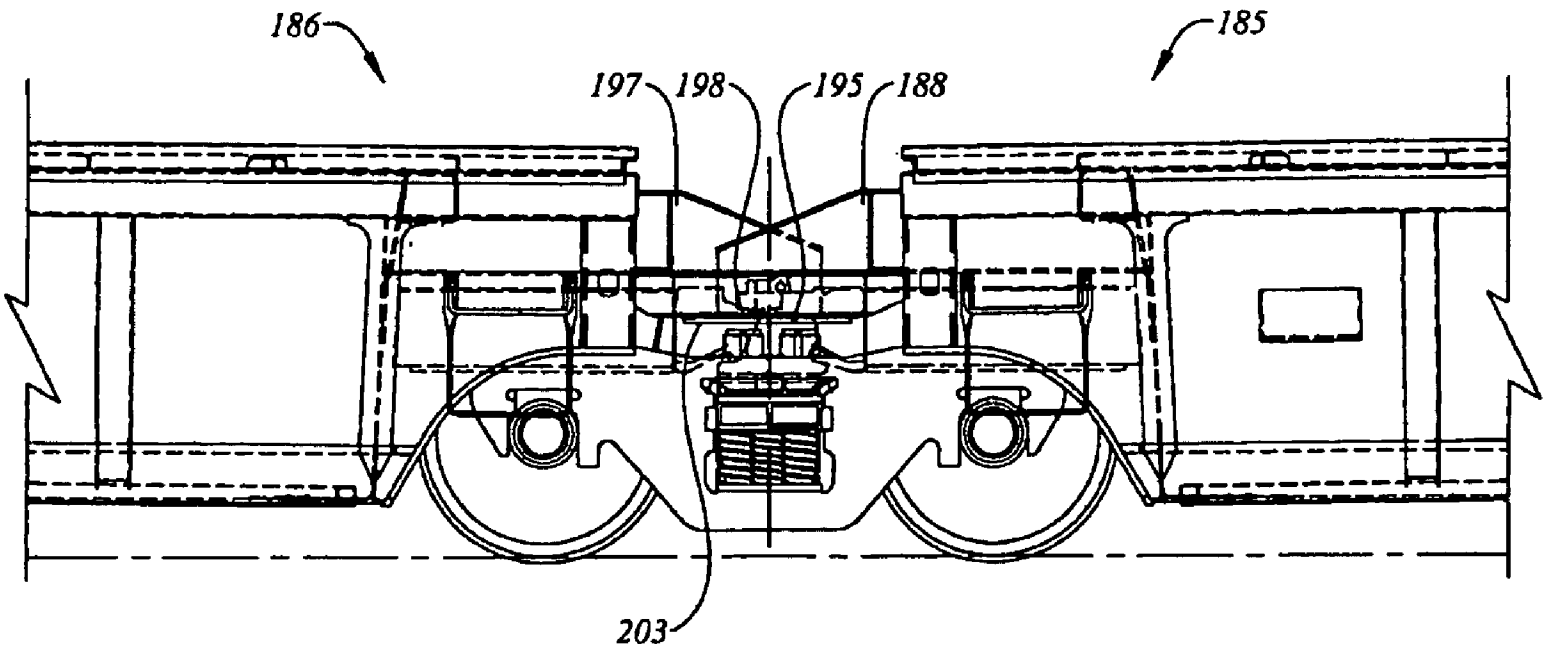
FIG. 7*f* is a side view of the portion of the three-unit articulated rail road car shown in FIG. 7*e;*

In an alternative embodiment, the opposing pairs of side-bearing arms associated with adjacent rail car units may be mutually engaging in a male-female relationship. FIGS. 7*e* and 7*f*, show adjacent rail car units 185 and 186. Rail car unit 185 has a pair of female side-bearing arms 187 and 188 mounted thereto. Each female side-bearing arm 187, 188 terminates in an inverted, generally U-shaped distal end 190. Distal end 190 forms a channel 191 having a back 192 from which depends a pair of spaced-apart flanges 193 and 194. Back 192 includes a downwardly facing bearing surface 195. A space is defined between flanges 193 and 194 for accommodating an opposing pair of male side-bearing arms 196 and 197 of rail car unit 186. Arranged in this manner, the male side-bearing arms 196 and 197 fit within the female side-bearing arms 187 and 188.

Each male side-bearing arm 196, 197 has an upwardly facing bearing surface 198 located opposite downwardly facing bearing surface 195 of female side-bearing arms 187 and 188. A wear pad 203 is located between bearing surfaces 195 and 198 of each male-female pairing of side-bearing arms 187, 196, and 188, 197. In a modification to this arrangement, it would be possible to reverse the orientation of the male and female bearing surfaces such that the bearing surface of female side-bearing arms are upwardly facing and correspondingly, the bearing surface of male side-bearing arms are downwardly facing.

A three-unit articulated rail road car may be constructed using any of the various alternative arrangements of side-bearing arms described and shown in FIGS. 7*b* to 7*f*, whether the intermediate unit is provided with identical female articulated connector portions (as in the preferred embodiment of FIGS. 4*a* and 4*b*) or identical male articulated connector portions (as in the embodiment of FIG. 6).

Five-Unit Articulated Rail Road Car

Figure 8A:
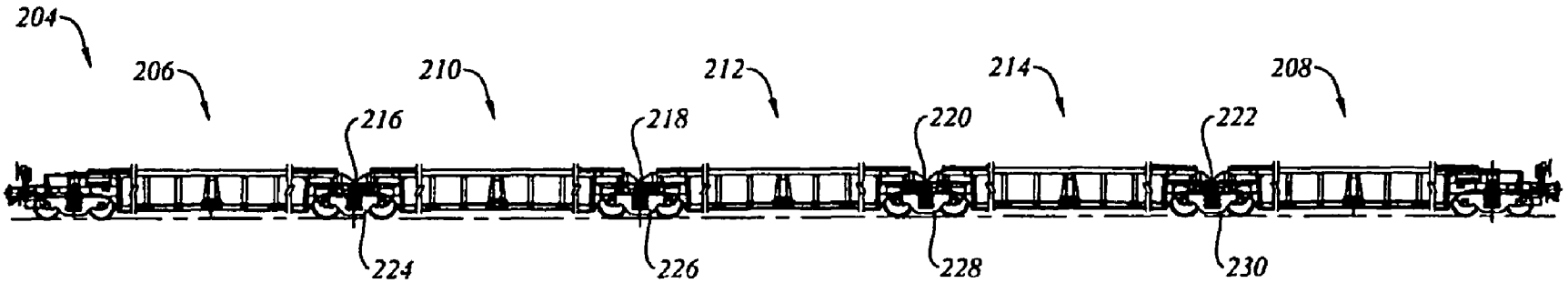
FIG. 8*a* is a side view of an example of an embodiment of a five-unit articulated rail road car according to an aspect of the present invention.
Figure 8B:
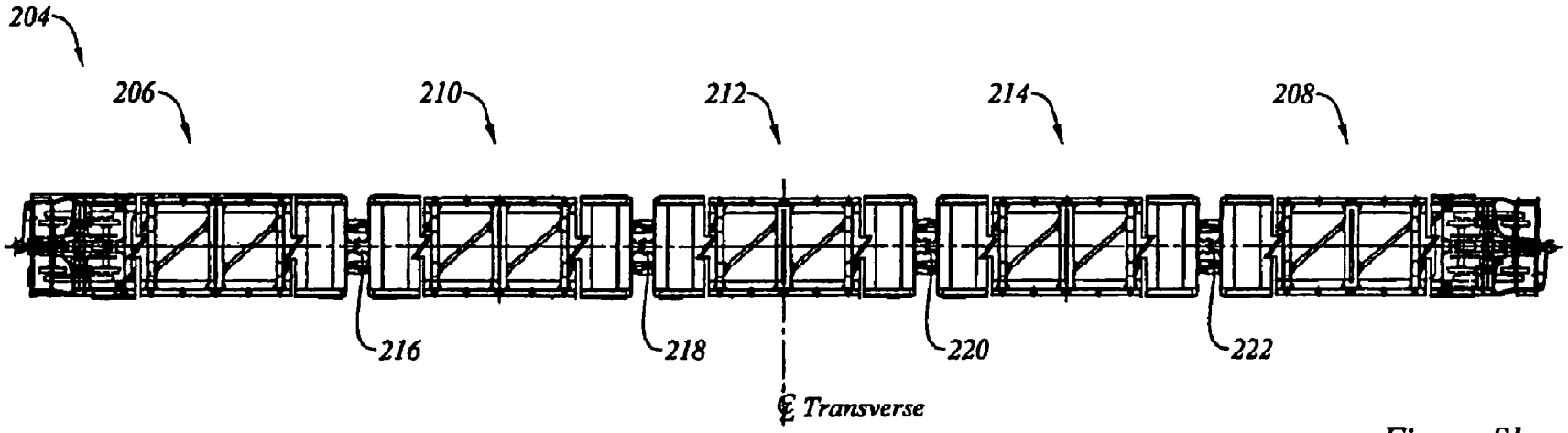
FIG. 8*b* is a top view of the five-unit articulated rail road car of FIG. 8*a;*
Figure 8C:
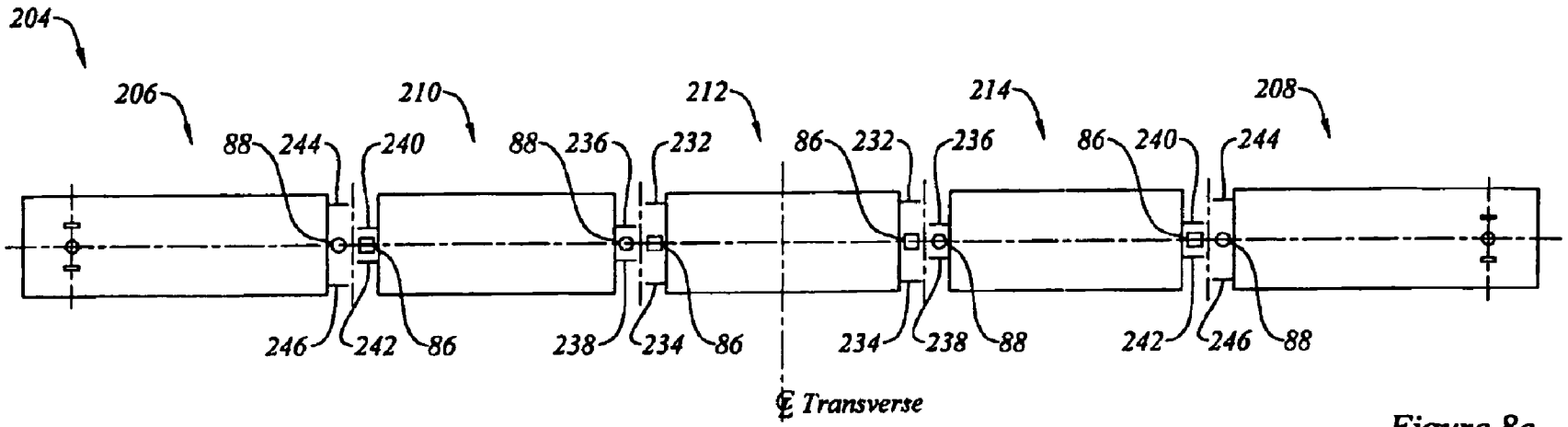
FIG. 8*c* is a schematic top view of the five-unit articulated rail road car of FIG. 8*b;*

FIGS. 8*a* to 8*c* show a five-unit articulated rail road car 204. Car 204 has two end units 206 and 208, and three intermediate units 210, 212 and 214 connected therebetween. Unit 212 is the centre unit. The various units 206, 210, 212, 214 and 208 are joined end-to-end by articulated connectors 216, 218, 220 and 222. Each articulated connector 216, 218, 220, 222 is supported on a respective shared truck 224, 226, 228, 230.

Car 204 is symmetrical about the mid-span centerline of center unit 212 (indicated in FIG. 8*b* as 'CL-Transverse') such that intermediate units 210 and 214 are mirror images one of the other, as are end units 206 and 208. Accordingly, for the sake of brevity it will suffice to describe the arrangement of units 206, 210 and 212.

Center unit 212 has mounted at each end a female articulated connector portion 86 and a relatively wide pair of side-bearing arms 232 and 234 for locating in a nested arrangement with narrower side-bearing arms 236 and 238 of the respective adjacent intermediate unit 210 or 214, as the case may be. Intermediate unit 210 has a conventional asymmetric arrangement of articulated connector portions. Intermediate unit 210 has a male articulated connector portion 88 at the end adjacent center unit 212 and a female articulated connector portion 86 at the opposite end thereof. A pair of side bearing arms 240 and 242 identical to side bearing arms 236 and 238 is mounted to the end of intermediate unit 210 adjacent end unit 206 such that intermediate unit 210 has a symmetrical arrangement of side-bearing arms. End unit 206 is generally similar to end unit 22, but differs in that it has a wide pair of side-bearing arms 244 and 246 for locating in a nested arrangement with narrower side-bearing arms 240 and 242 of intermediate unit 210.

In the embodiment shown in FIGS. 8*a* to 8*c*, center unit 212 has identical female articulated connector portions 86 at both ends thereof, intermediate unit 214 has an asymmetrical arrangement of articulated connector portions, namely a male connector portion 88 at one end to mate with center unit 212, and a female connector portion 86 at the opposite end thereof; and end unit 206 is provided with a male articulated connector portion 88. In an alternate rail road car to that of car 204, the articulated connector portions associated with each railcar unit may be changed from male to female, or female to male, as the case may be.

Figure 10A:
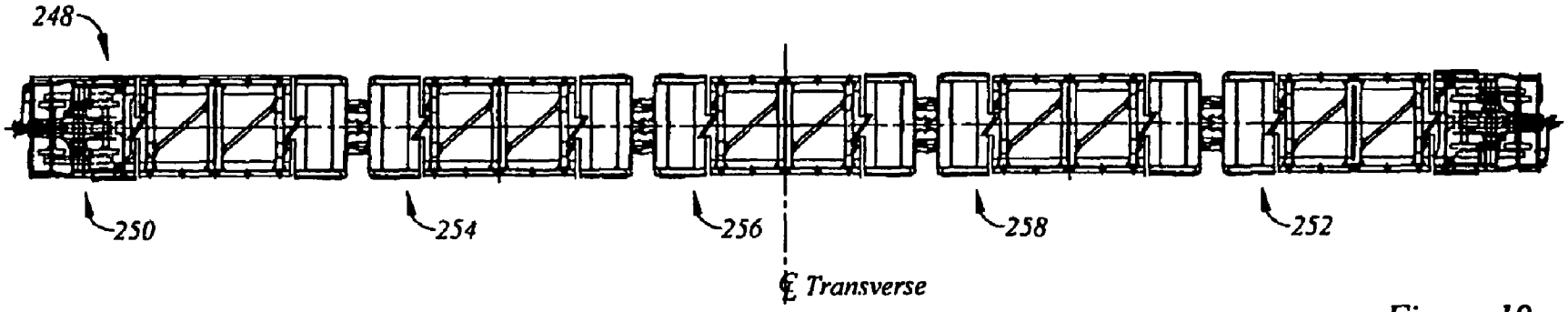
FIG. 10*a* is a top view of an alternative embodiment of the five-unit articulated rail road car shown in FIG. 8*b;*
Figure 10B:
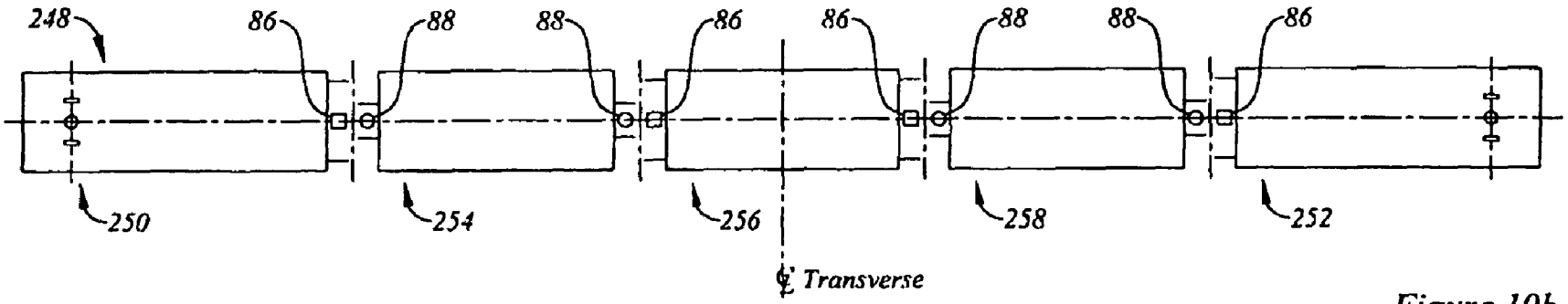
FIG. 10*b* is a schematic top view of the five-unit articulated rail road car shown in FIG. 10*a;*
Figure 10C:
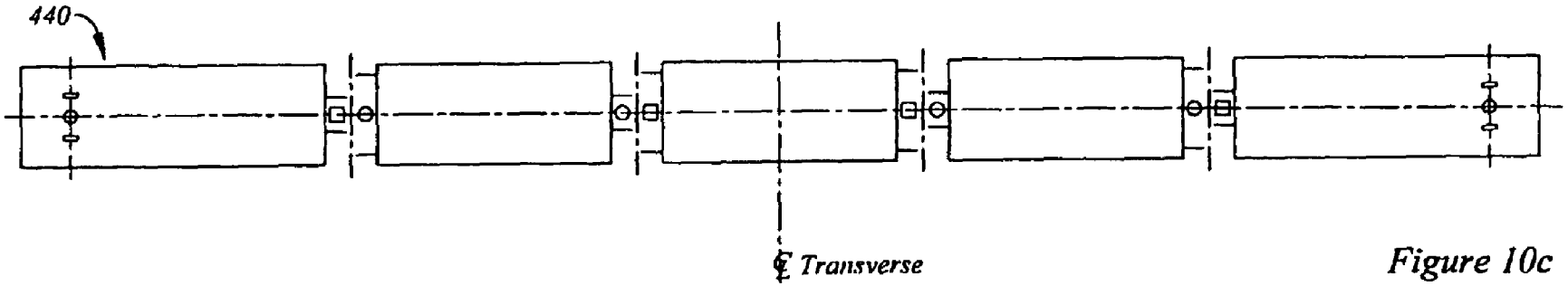
FIG. 10*c* is a schematic top view of a five-unit articulated rail road car showing a first alternative arrangement of side bearing arms to that shown in FIG. 10*b;*
Figure 10D:
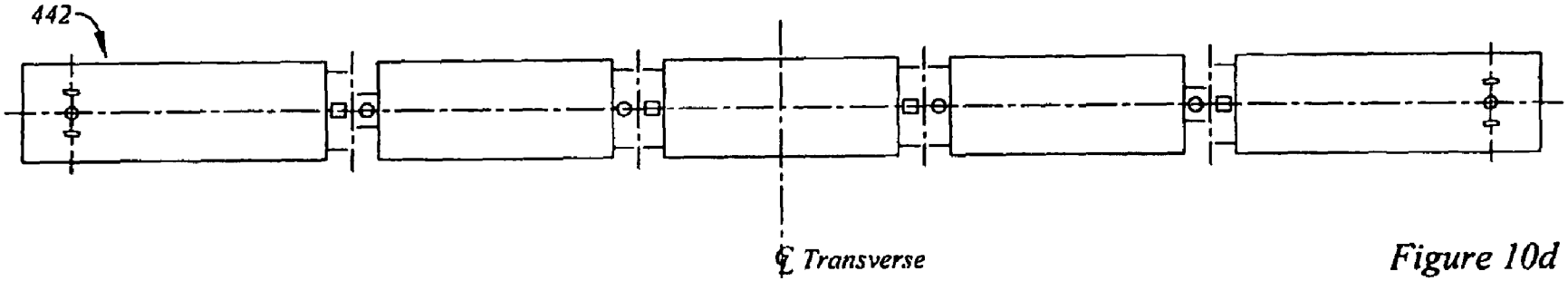
FIG. 10*d* is a schematic top view of a five-unit articulated rail road car showing a second alternative arrangement of side bearing arms to that shown in FIG. 10*b;*
Figure 10E:
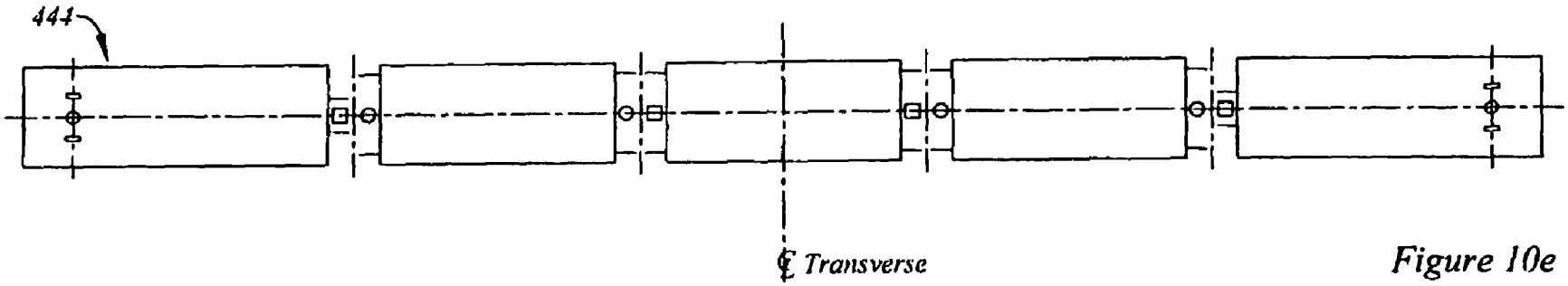
FIG. 10*e* is a schematic top view of a five-unit articulated rail road car showing a third alternative arrangement of side bearing arms to that shown in FIG. 10*b;*
Figure 10F:
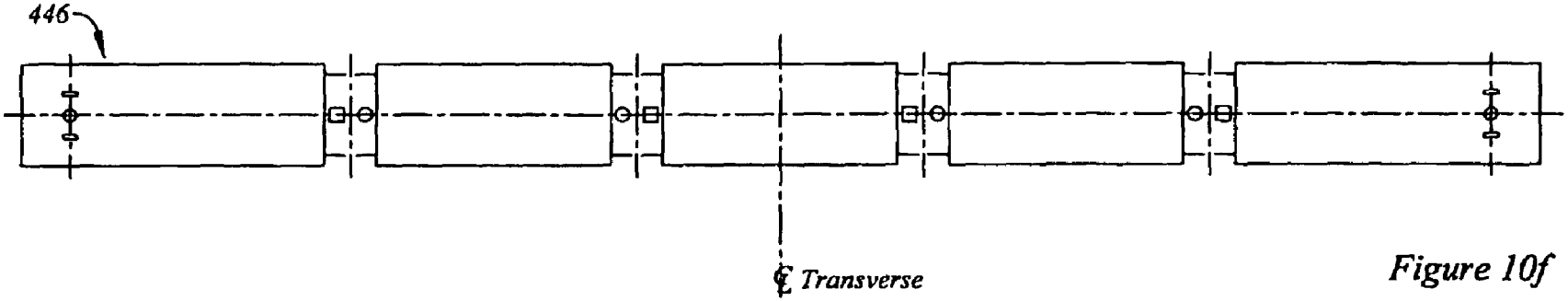
FIG. 10*f* is a schematic top view of a five-unit articulated rail road car showing a fourth alternative arrangement of side bearing arms to that shown in FIG. 10*b;*
Figure 10G:
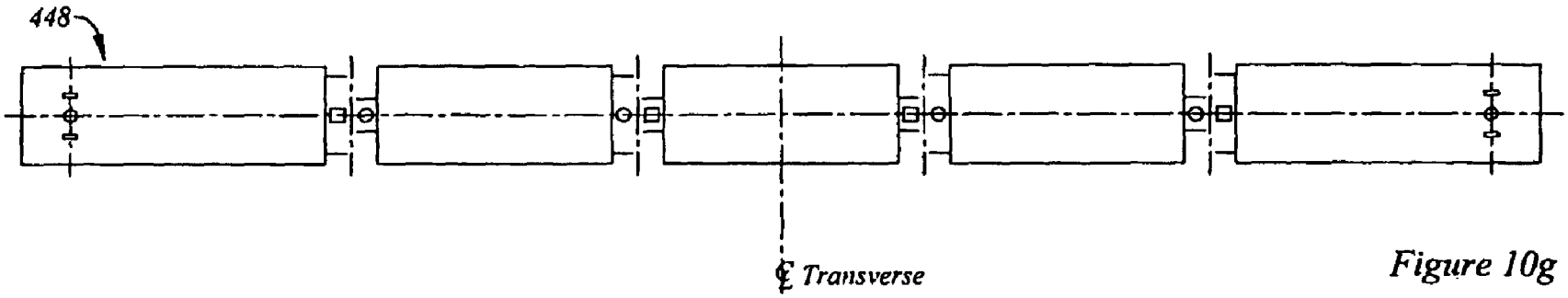
FIG. 10*g* is a schematic top view of a five-unit articulated rail road car showing a fifth alternative arrangement of side bearing arms to that shown in FIG. 10*b;*
Figure 10H:
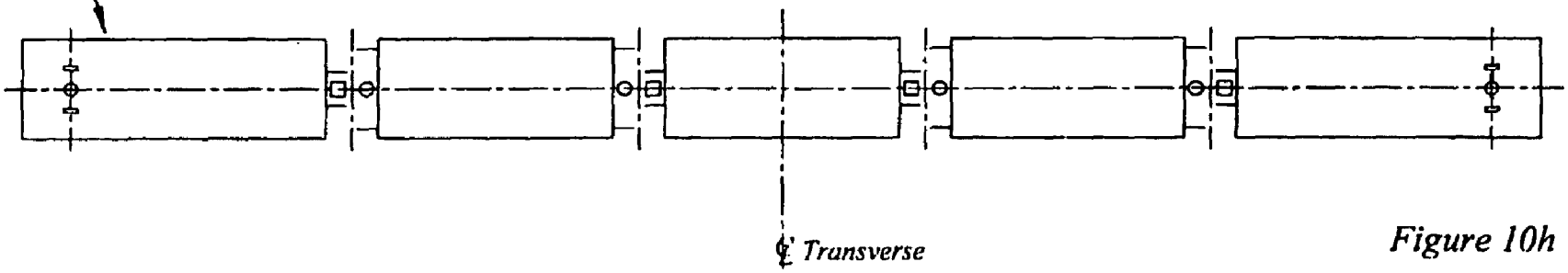
FIG. 10*h* is a schematic top view of a five-unit articulated rail road car showing a sixth alternative arrangement of side bearing arms to that shown in FIG. 10*a;*

FIGS. 10*a* and 10*b* show a five-unit articulated railroad car 248 similar in construction to car 204. Car 248 has two end units 250 and 252 and three intermediate units 254, 256 and 258, with unit 256 as the center unit. Similar to car 204, car 248 is symmetrical about the mid-span centerline of center unit 256 (indicated in FIG. 10*a* as 'CL-Transverse'). However, in this embodiment, center unit 256 is provided with female articulated connector portions 86 at both ends. Intermediate unit 254 has male articulated connector portions 88 at both ends, such that the end adjacent center unit 256 has a male articulated connector portion 88 and the opposite end thereof also has male articulated connector portion 88 adjacent to end unit 250. Correspondingly, end unit 250 has a female articulated connector portion 86. As shown in FIG. 10*b*, the arrangement of side-bearing arms on car 248 is the same as on car 204.

Figure 11A:
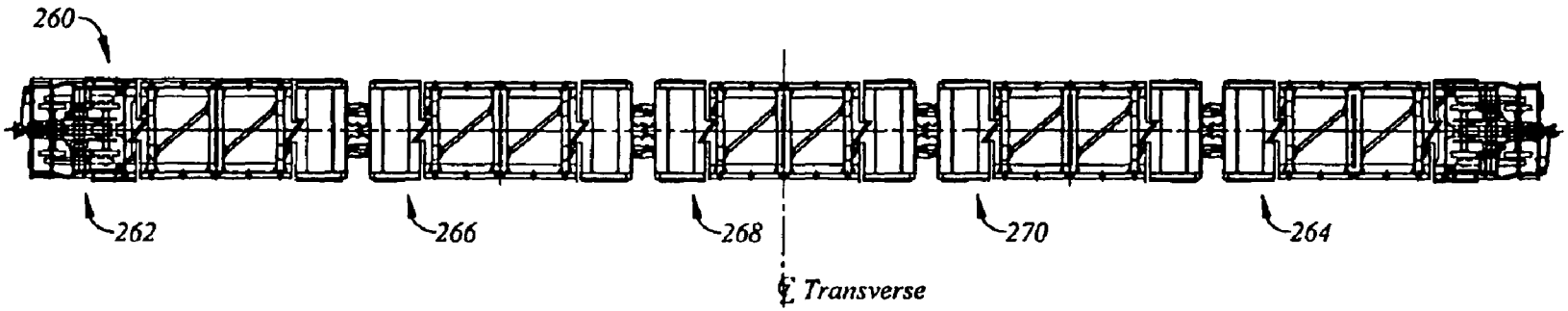
FIG. 11*a* is a top view of a further alternative embodiment of the five-unit articulated rail road car in FIG. 8*b;*
Figure 11B:
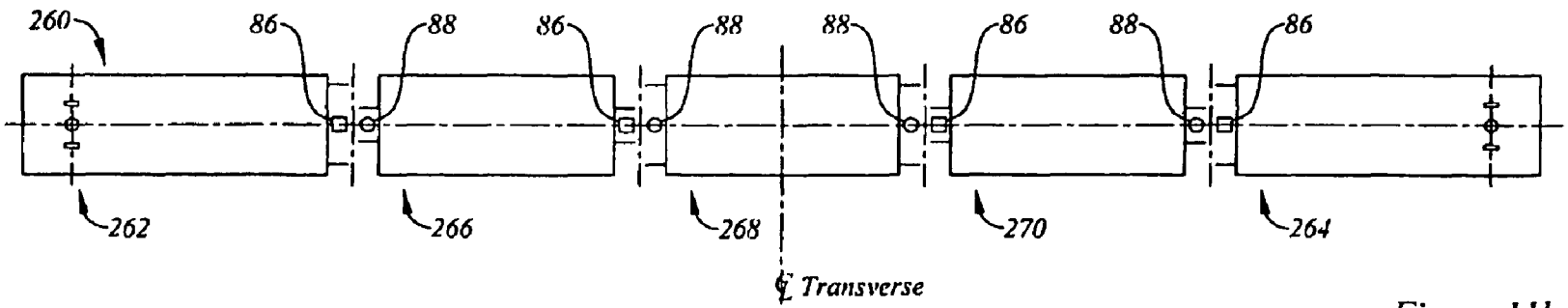
FIG. 11*b* is a schematic top view of the five-unit articulated rail road car shown in FIG. 11*a;*
Figure 11C:
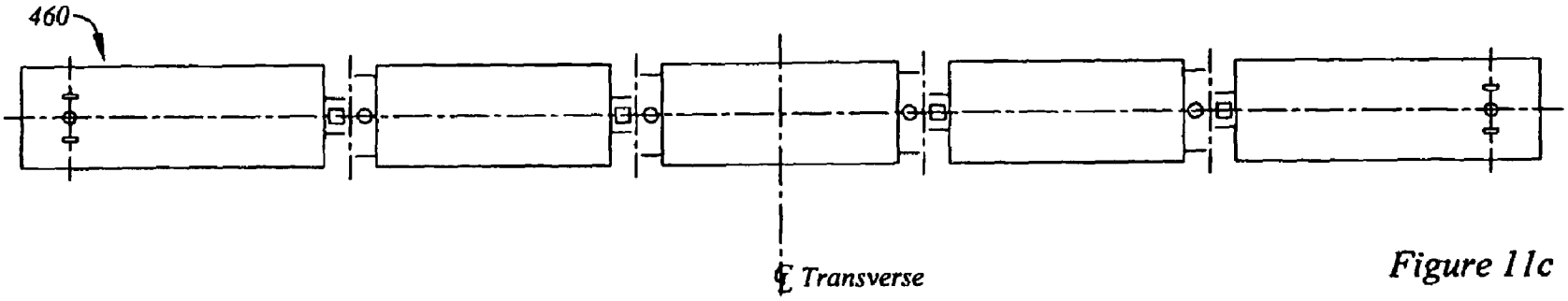
FIG. 11*c* is a schematic top view of a five-unit articulated rail road car showing a first alternative arrangement of side bearing arms to that shown in FIG. 11*b;*
Figure 11D:
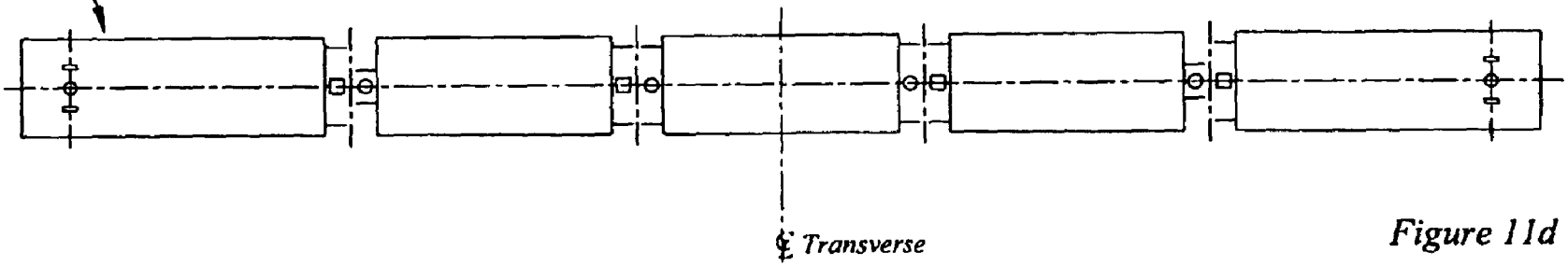
FIG. 11*d* is a schematic top view of a five-unit articulated rail road car showing a second alternative arrangement of side bearing arms to that shown in FIG. 11*b;*
Figure 11E:
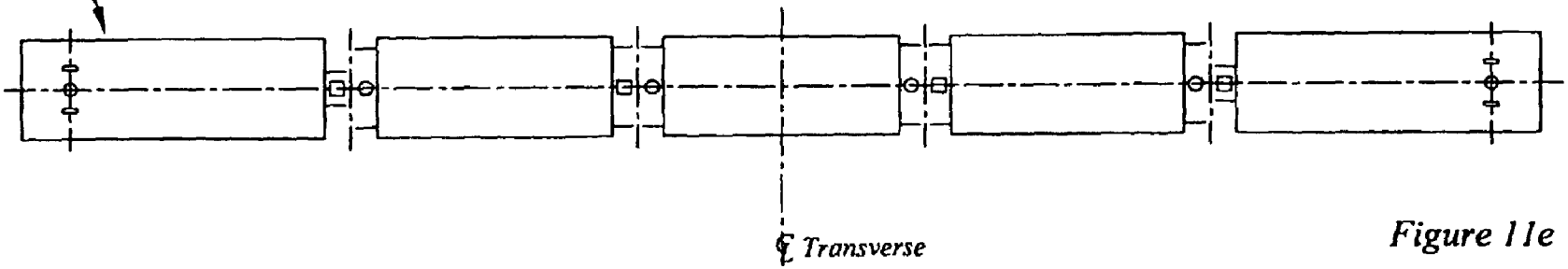
FIG. 11*e* is a schematic top view of a five-unit articulated rail road car showing a third alternative arrangement of side bearing arms to that shown in FIG. 11*b;*
Figure 11F:
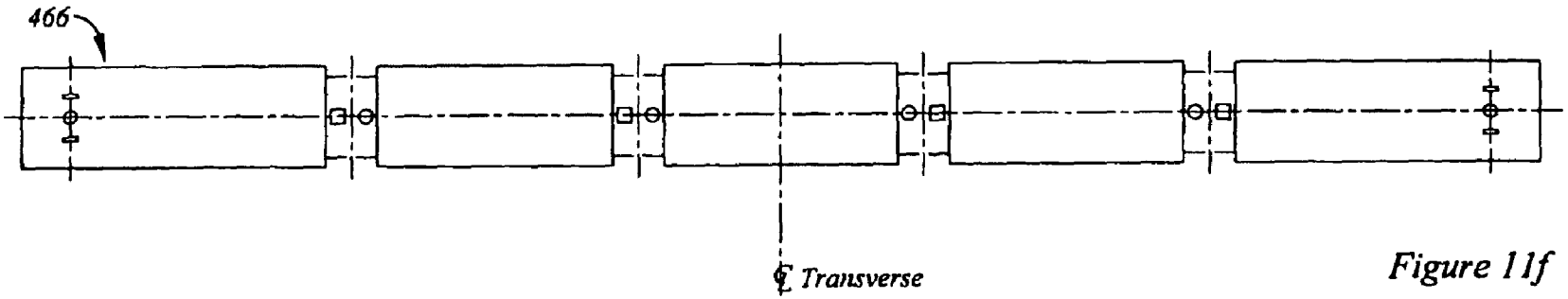
FIG. 11*f* is a schematic top view of a five-unit articulated rail road car showing a fourth alternative arrangement of side bearing arms to that shown in FIG. 11*b;*
Figure 11G:
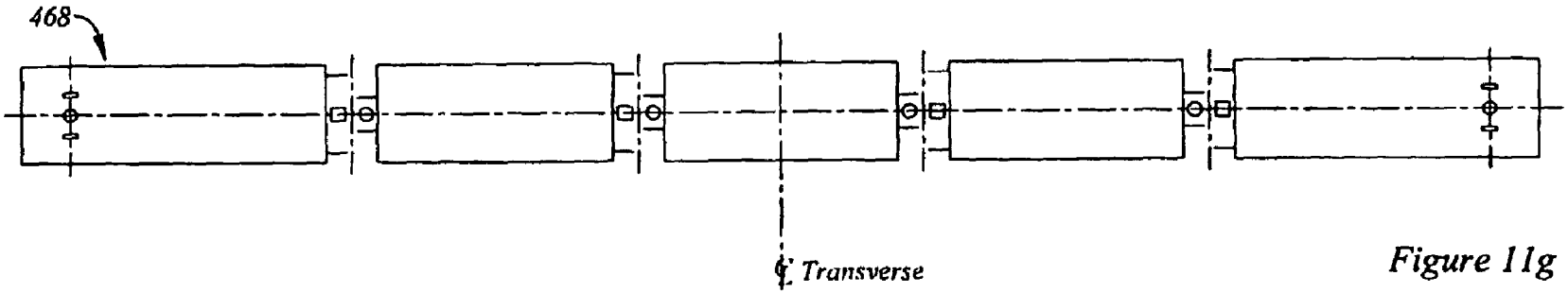
FIG. 11*g* is a schematic top view of a five-unit articulated rail road car showing a fifth alternative arrangement of side bearing arms to that shown in FIG. 11*b;*
Figure 11H:
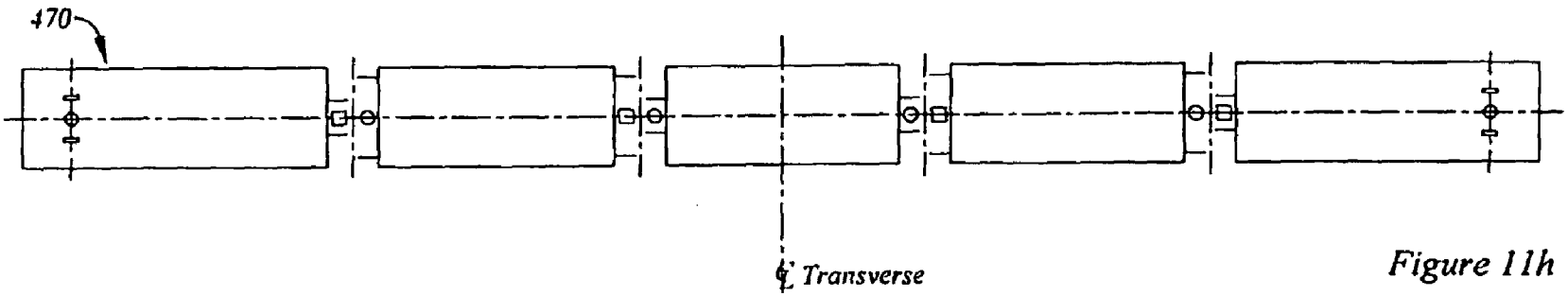
FIG. 11*h* is a schematic top view of a five-unit articulated rail road car showing a sixth alternative arrangement of side bearing arms to that shown in FIG. 11*b;*

Other variations to the articulated connection arrangements in a five-unit articulated rail road car are possible. For instance, in cars 204 and 260, only center units 212 and 268 have identical articulated connector portions at each end, namely, two male connector portions 88 at the ends of unit 212, and two female connector portions 86 at the ends of unit 268. The other, intermediate, units 266, 270, each have one male connector portion and one female connector portion. In FIGS. 11*a* and 11*b*, five-unit articulated rail road car 260 has two end units 262 and 264, and three intermediate units 266, 268 and 270. Intermediate unit 268 is the centre unit. Car 260 is similar to car 204 in that it is also symmetrical about the mid-span centerline of center unit 268 (indicated in FIG. 11*a* as 'CL-Transverse'). In this embodiment, center unit 268 has two male articulated connector portions 88 and intermediate neighbouring units 266 and 270 have two female articulated connector portions 86 adjoining unit 268, and male connector portions 88 adjoining unit 262, or 264, as may be. Correspondingly, end unit 262 has a female articulated connector portion 86. As shown in FIG. 11*b*, the arrangement of side-bearing arms on car 260 is the same as on car 204.

Figure 12A:
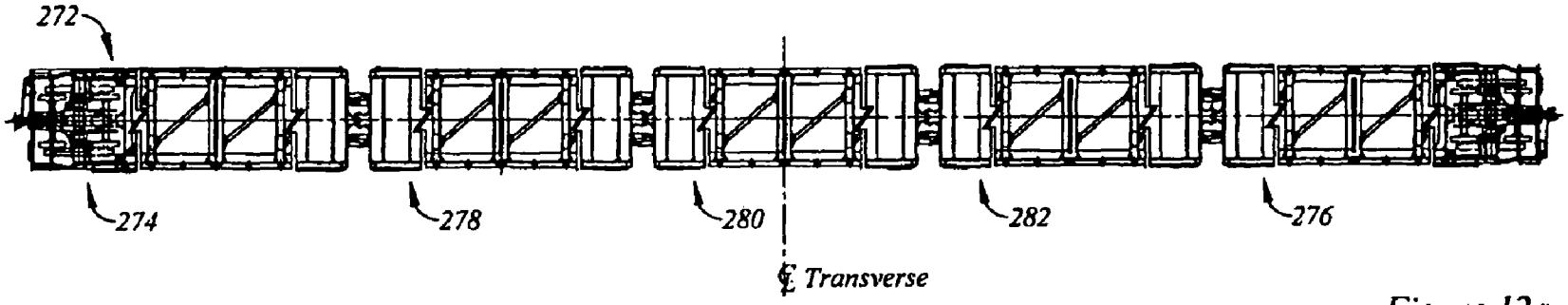
FIG. 12*a* is a top view of an additional alternative embodiment of the five-unit articulated rail road car in FIG. 8*b;*
Figure 12B:
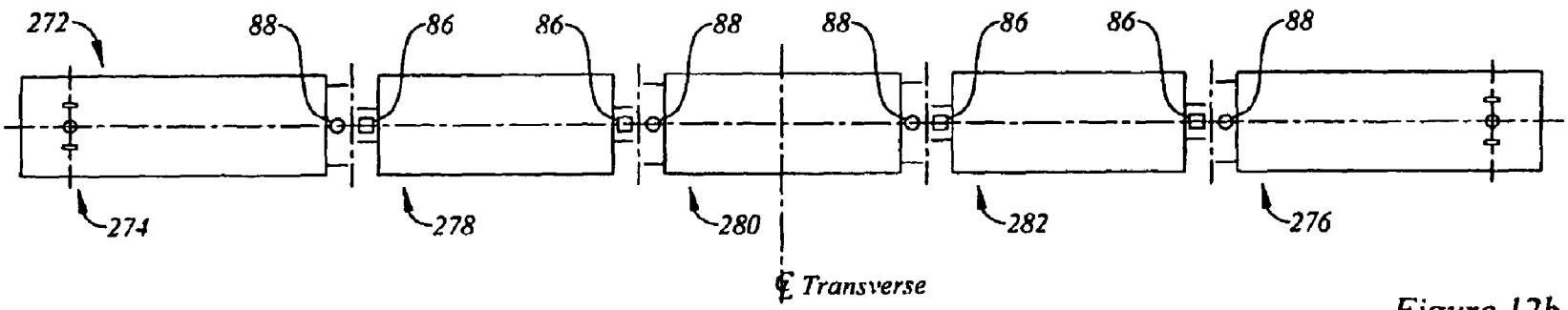
FIG. 12*b* is a schematic top view of the five-unit articulated rail road car shown in FIG. 12*a;*
Figure 12C:
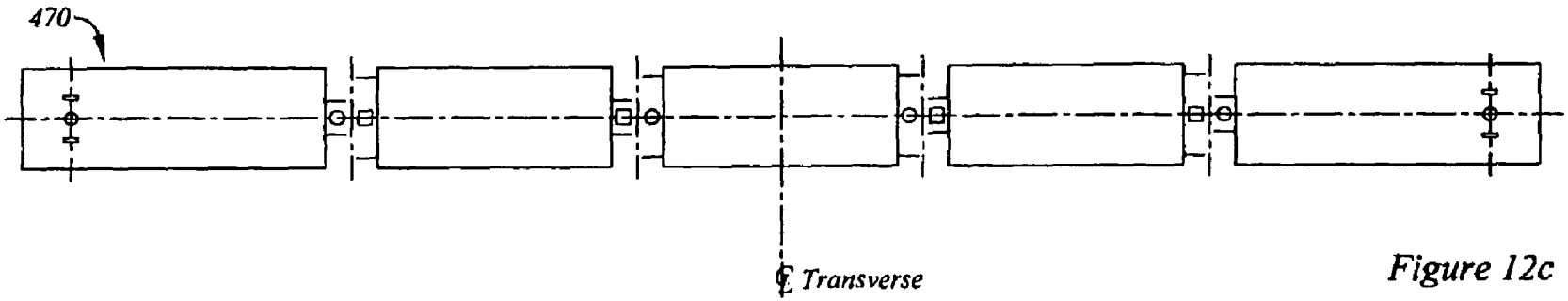
FIG. 12*c* is a schematic top view of a five-unit articulated rail road car showing a first alternative arrangement of side bearing arms to that shown in FIG. 12*b;*
Figure 12D:
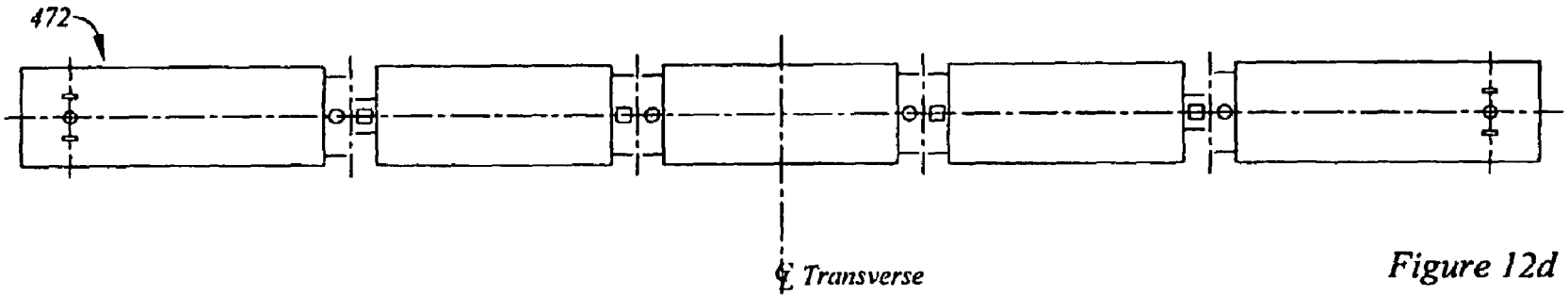
FIG. 12*d* is a schematic top view of a five-unit articulated rail road car showing a second alternative arrangement of side bearing arms to that shown in FIG. 12*b;*
Figure 12E:
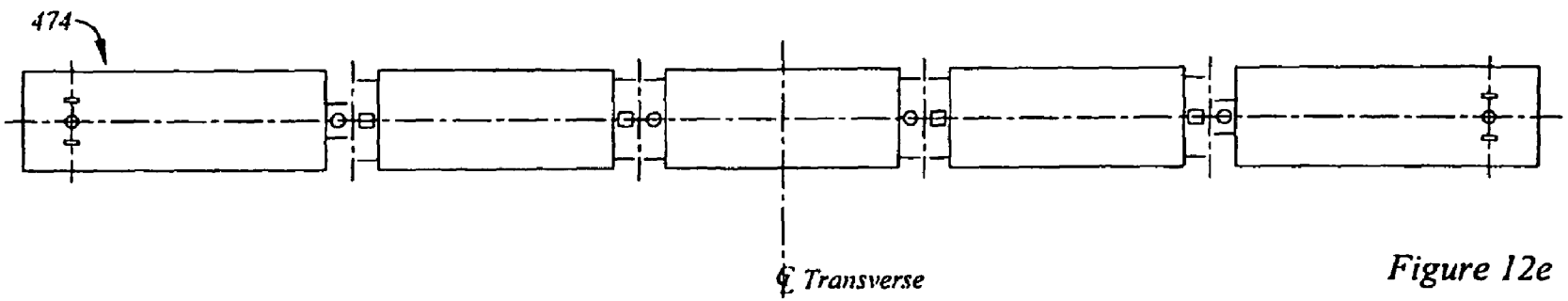
FIG. 12*e* is a schematic top view of a five-unit articulated rail road car showing a third alternative arrangement of side bearing arms to that shown in FIG. 12*b;*
Figure 12F:
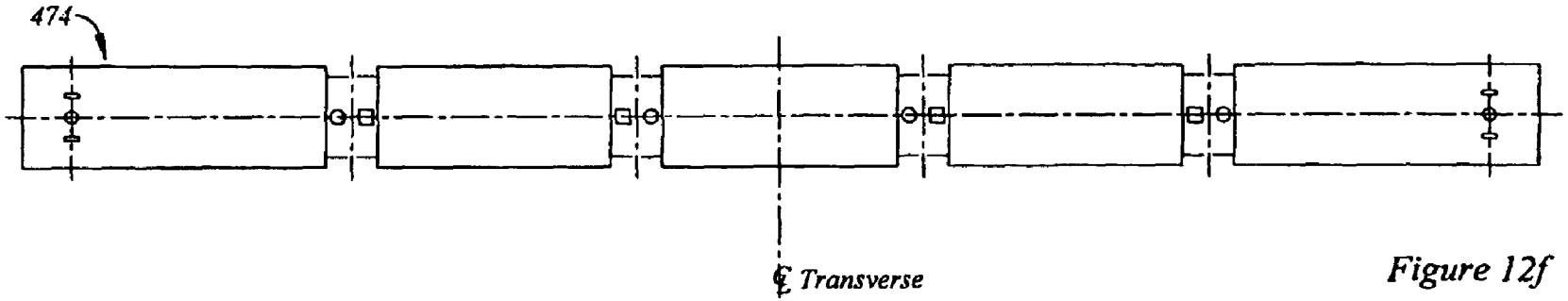
FIG. 12*f* is a schematic top view of a five-unit articulated rail road car showing a fourth alternative arrangement of side bearing arms to that shown in FIG. 12*b;*
Figure 12G:
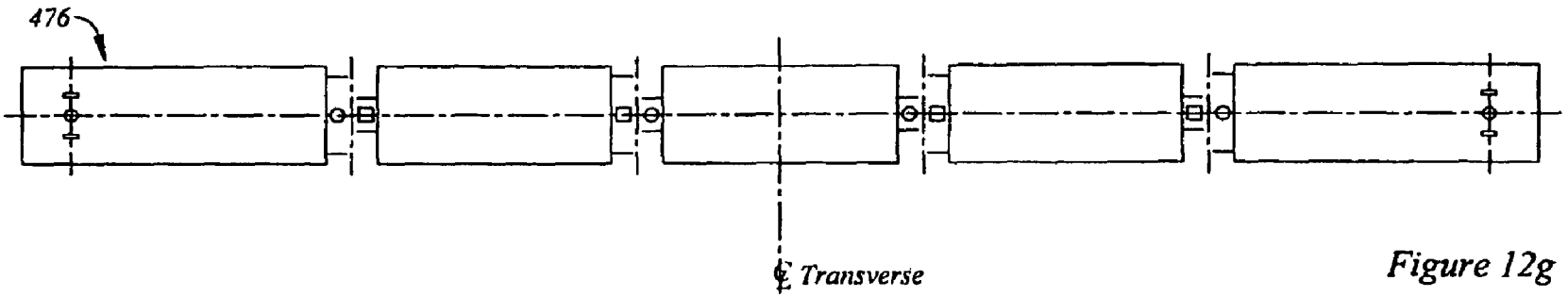
FIG. 12*g* is a schematic top view of a five-unit articulated rail road car showing a fifth alternative arrangement of side bearing arms to that shown in FIG. 12*b; and*
Figure 12H:
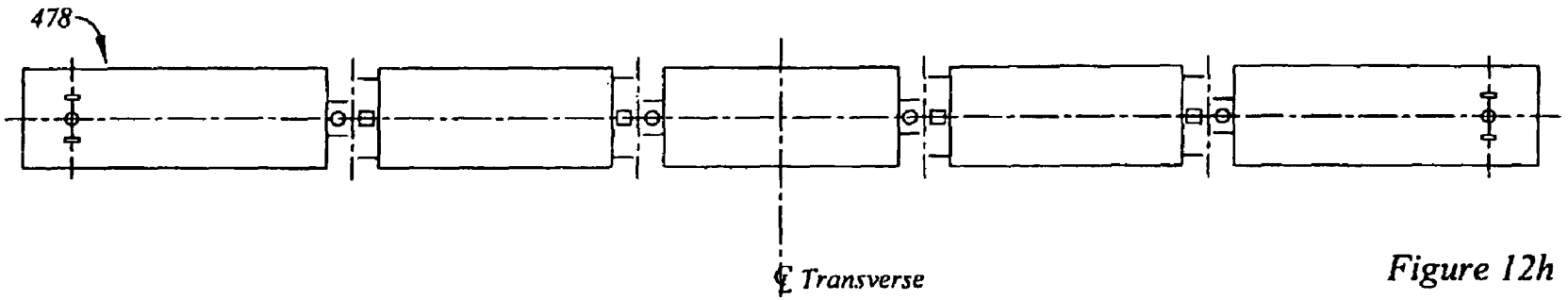
FIG. 12*h* is a schematic top view of a five-unit articulated rail road car showing a sixth alternative arrangement of side bearing arms to that shown in FIG. 12*b.*

Alternatively, a similar arrangement to that of car 248 may be achieved by changing the articulated connector portions associated with each railcar unit from male to female, or female to male, as the case may be. With reference to FIGS. 12*a* and 12*b*, a five-unit articulated rail road car 272 has two end units 274 and 276 and three intermediate units 278, 280 and 282 with intermediate unit 280 as the centre unit. In this embodiment, centre unit 280 has male articulated connector portions 88 at both ends and intermediate units 278, 282 have female articulated connector portions 86 at both ends. Correspondingly, a male articulated connector portion is mounted to the end of end unit 274 (or 276, as may be) adjacent intermediate unit 278 (or 282, as may be). As shown in FIG. 12*b*, the arrangement of side-bearing arms on car 272 is the same as on car 204.

In the embodiment shown in FIGS. 8*a* to 8*c*, intermediate unit 210 has narrow pairs of side-bearing arms 236, 238 and 240, 242 mounted at opposite ends for locating in a nested arrangement with relatively wider pairs of side-bearing arms 232, 234 (of centre unit 212) and 244, 246 (of end unit 206), respectively. However, alternate arrangements of side-bearing arms may also be possible. For instance, different arrangements of nested side-bearing arms may be employed. Alternatively, arrangements having equally laterally spaced, opposing pairs of side-bearing arms could be used. In the further alternative, a five-unit articulated rail road car could use a combination of nested side-bearing arms and equally laterally spaced opposing side-bearing arm arrangements.

Figure 9A:
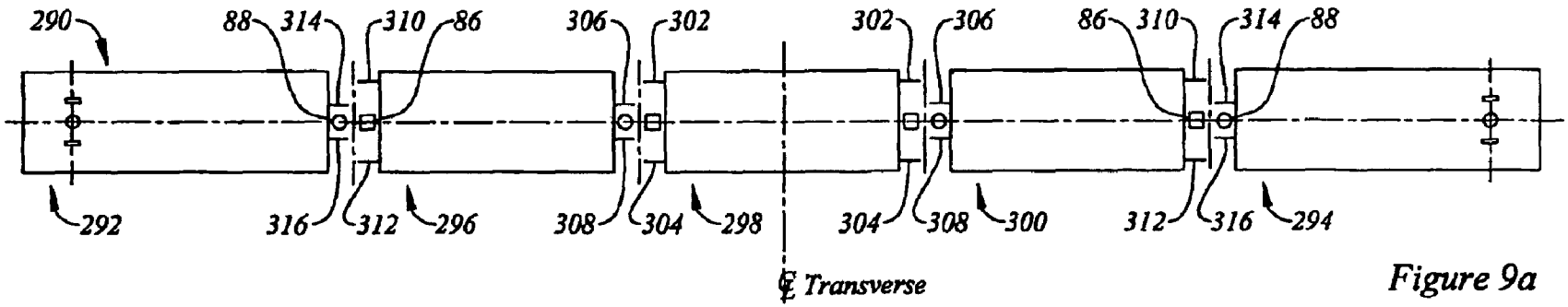
FIG. 9*a* is a schematic top view of a five-unit articulated rail road car showing a first alternative arrangement of side bearing arms to that shown in FIG. 8*c;*

Referring to FIG. 9*a*, a five-unit articulated rail road car 290 has two end units 292 and 294, and three intermediate units 296, 298 and 300 with unit 298 as the center unit. Car 290 is symmetrical about the mid-span centerline of center unit 298 (indicated in FIG. 9*a* as 'CL-Transverse'). Center unit 298 is substantially identical to center unit 212 described above and shown in FIG. 8*b*, with identical pairs of side-bearing arms 302 and 304 mounted at each end thereof. Intermediate unit 296 has a narrow pair of side-bearing arms 306 and 308 mounted at an end thereof adjacent center unit 298 and a relatively wide pair of side-bearing arms 310 and 312 mounted at the opposite end. Side-bearing arms 306 and 308 nest within the wider pair of side-bearing arms 302 and 304 associated with the adjacent end of center unit 298. End unit 292 is similar in construction to end unit 206 described above but differs in that it has a relatively, narrower pair of side-bearing arms 314 and 316 for locating in a nested arrangement with the opposing wide pair of side-bearing arms 310 and 312 of intermediate unit 296.

Figure 9B:
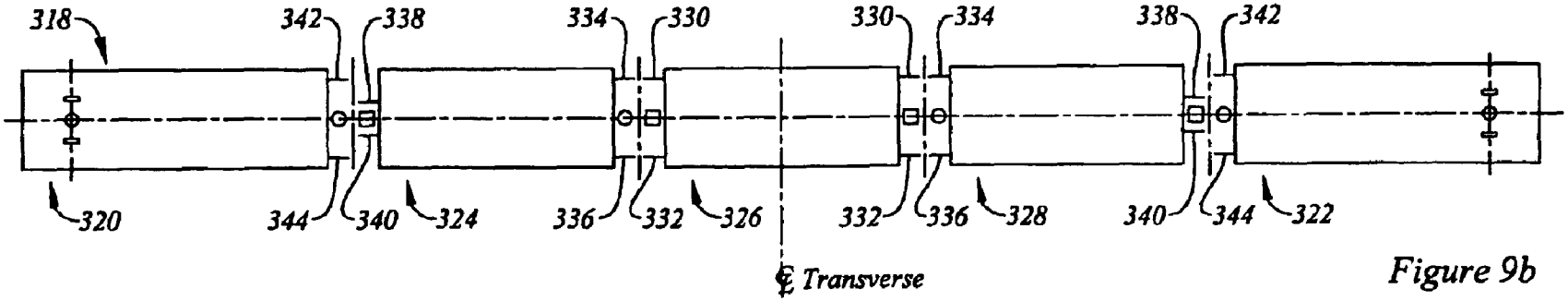
FIG. 9*b* is a schematic top view of a five-unit articulated rail road car showing a second alternative arrangement of side bearing arms to that shown in FIG. 8*c;*

FIG. 9*b* shows an alternate five-unit articulated rail road car 318 having two end units 320 and 322, and three intermediate units 324, 326 and 328 with unit 326 as the center unit. Car 318 is symmetrical about the mid-span centerline of center unit 326 (indicated in FIG. 9*b* as 'CL-Transverse'). Center unit 326 is substantially identical to center unit 212 with identical pairs of side-bearing arms 330 and 332 mounted at either end. End unit 320 is substantially identical to end unit 206 described above and shown in FIG. 8*b*. Intermediate unit 324 is generally similar to intermediate unit 296, but with its side-bearing arm arrangements reversed such that at an end adjacent center unit 326, intermediate unit 324 has a wide pair of side-bearing arms 334 and 336 while at the opposite end thereof, there is mounted a narrow pair of side-bearing arms 338 and 340. Similar to the side-bearing arrangement shown in FIG. 7*d*, the distal ends of the pair of side-bearing arms 334 and 336 are longitudinally aligned with the distal ends of the opposing pair of side-bearing arms 330 and 332 associated with the center unit 326. Narrow pair of side-bearing arms 338 and 340 are nested within an opposing wider pair of side-bearing arms 342 and 344 associated with end unit 320.

Figure 9C:
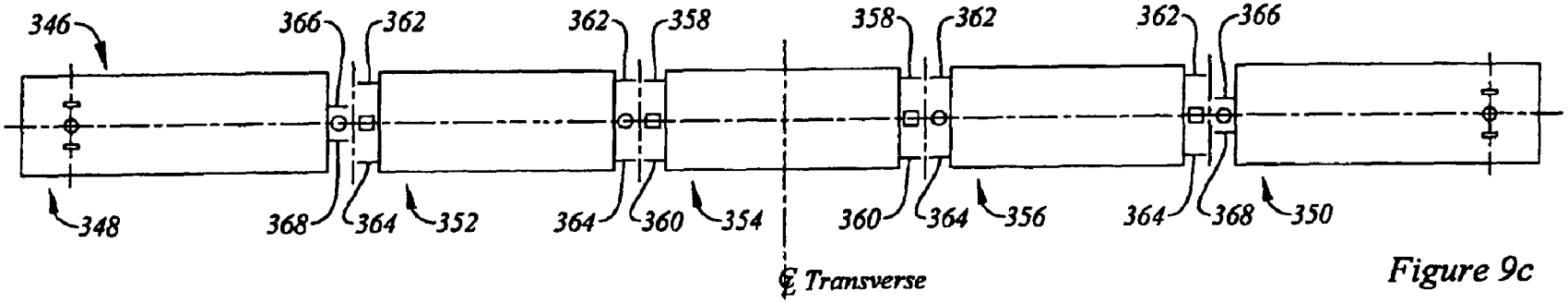
FIG. 9*c* is a schematic top view of a five-unit articulated rail road car showing a third alternative arrangement of side bearing arms to that shown in FIG. 8*c;*

FIG. 9*c* shows an another alternate five-unit articulated rail road car 346. Car 346 has two end units 348 and 350, and three intermediate units 352, 354 and 356 with unit 354 as the center unit. Car 346 is symmetrical about the mid-span centerline of center unit 354 (indicated in FIG. 9*c* as 'CL-Transverse'). Center unit 354 is substantially identical to center unit 212 with identical pairs of side-bearing arms 358 and 360 mounted at each end thereof. End unit 348 is identical to end unit 292 described above and shown in FIG. 9*a*. Intermediate unit 352 has identical, relatively wide, pairs of side-bearing arms 362 and 364 at either end. In this embodiment, at the end of intermediate unit 352 adjacent center unit 354, the distal ends of side-bearing arms 362 and 364 are longitudinally aligned with the distal ends of the side-bearing arms 358 and 360 mounted to center unit 354. At the opposite end of intermediate unit 354, a relatively narrow pair of side-bearing arms 366 and 368 associated with end unit 348 nest within the wider pair of side-bearing arms 362 and 364.

Figure 9D:
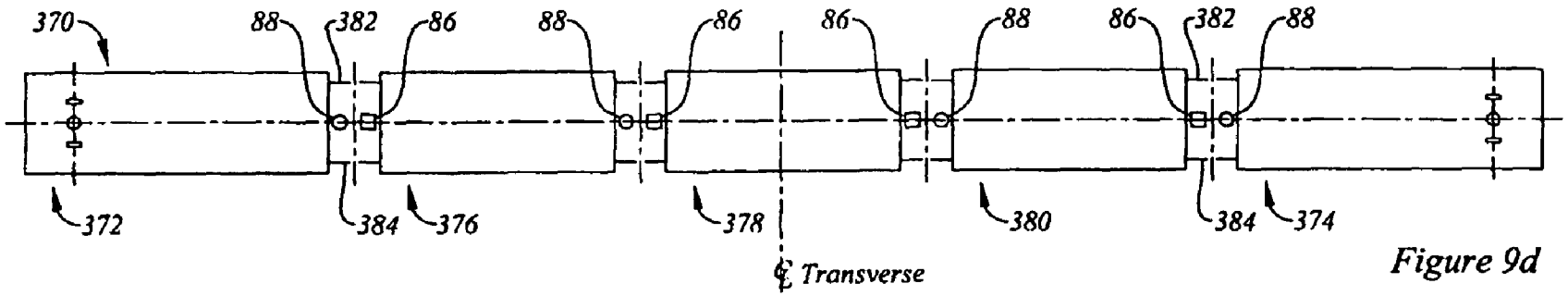
FIG. 9*d* is a schematic top view of a five-unit articulated rail road car showing a fourth alternative arrangement of side bearing arms to that shown in FIG. 8*c;*

FIG. 9*d* shows a further alternate five-unit articulated rail road car 370. Car 370 is generally similar to car 346 described above and shown in FIG. 9*c*. It has two end units 372 and 374, and three intermediate units 376, 378 and 380 with unit 378 as the center unit. Car 370 differs from car 346 in that its end units 372 and 374 are provided with a relatively wide pair of side-bearing arms 382 and 384. In this embodiment, all side-bearing arm pairs are relatively wide and are arranged such that the distal ends of one pair of side-bearing arms are longitudinally aligned with the distal ends of an opposing other pair of side-bearing arms.

Figure 9E:
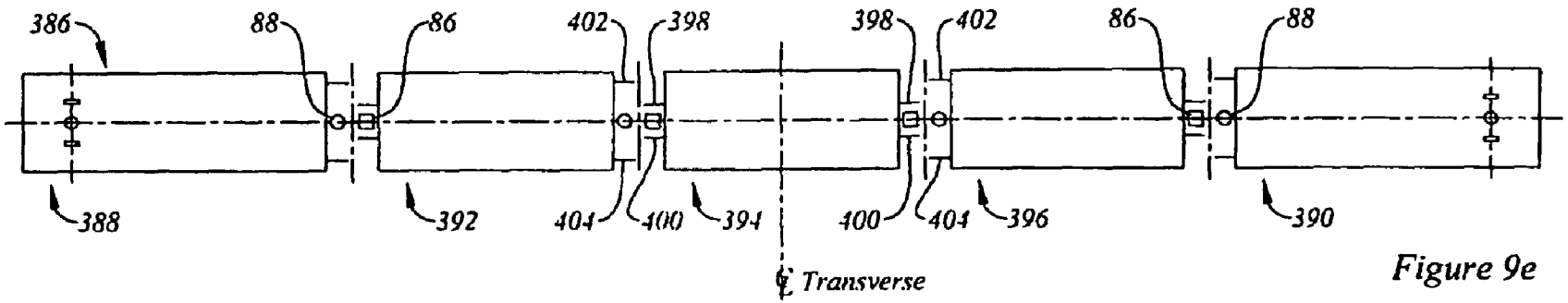
FIG. 9*e* is a schematic top view of a five-unit articulated rail road car showing a fifth alternative arrangement of side bearing arms to that shown in FIG. 8*c;*

FIG. 9*e* shows yet another alternate five-unit articulated rail road car 386. Car 386 has two end units 388 and 390, and three intermediate units 392, 394 and 396 with unit 394 as the center unit. Center unit 394 is substantially identical to middle unit 24 described above and shown in FIG. 2. It has identical pairs of relatively narrow side-bearing arms 398 and 400 mounted at each end. Intermediate unit 392 and end unit 388 are substantially identical to intermediate unit 324 and end unit 320 (shown in FIG. 9*b*), respectively. In this embodiment, each pair of side-bearing arms 398 and 400 of center unit 394 is disposed in a nested arrangement with an opposing wide pair of side-bearing arms 402 and 404 associated with each intermediate unit 392 and 396. The side-bearing arm arrangement between adjacent ends of units 388 and 392 is similar to that described above in connection with units 320 and 324.

Figure 9F:
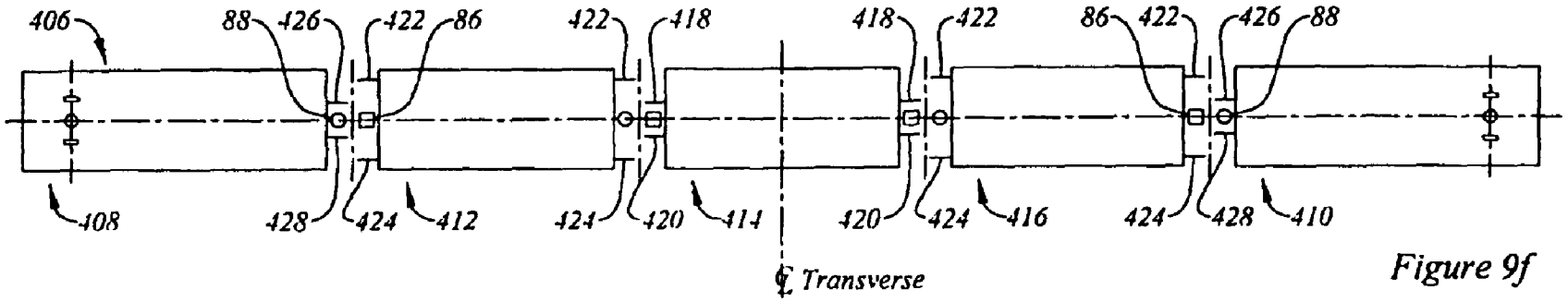
FIG. 9*f* is a schematic top view of a five-unit articulated rail road car showing a sixth alternative arrangement of side bearing arms to that shown in FIG. 8*c;*

FIG. 9*f* shows still another alternate five-unit articulated rail road car 406 having two end units 408 and 410, and three intermediate units 412, 414 and 416 with unit 414 as the center unit. In this embodiment, center unit 414 is substantially identical to center unit 394 with identical pairs of relatively narrow side-bearing arms 418 and 420 mounted at each end. End unit 408 and intermediate unit 412 are substantially identical to intermediate unit 348 and end unit 352 (shown in FIG. 9*c*), respectively. Mounted to each end of intermediate unit 412 is a pair of relatively wide side-bearing arms 422 and 424. One pair of side-bearing arms 422 and 424 is disposed in a nested relationship with the narrow pair of side-bearing arms 418 and 420 of center unit 414, while the other pair of side-bearing arms 422 and 424 is disposed in a nested relationship with a narrow pair of side-bearing arms 426 and 428 associated with end unit 408.

The embodiments of FIGS. 9*b*, 9*c* and 9*d* include side-bearing arrangements in which the distal ends of one pair of side-bearing arms are longitudinally aligned with the distal ends of another opposing pair of side-bearing arms in much the same manner as the side-bearing arm arrangement shown in FIG. 7*b*. Those side-bearing arm arrangements may be substituted for other side-bearing arrangements having opposing pairs of equally laterally spaced side-bearing arms, such as those shown in FIGS. 7*c*, 7*e* and 7*f* and described above. Alternatively, an arrangement of laterally staggered side-bearing arms such as shown in FIG. 7*d* may also be employed.

While various alternative side-bearing arm arrangements have been described for railroad cars possessing a configuration of articulated connections similar to that of car 204, these side-bearing arm arrangements may also be employed in cars having different articulated connection configurations. FIGS. 10*c* to 10*h* show various side-bearing arm arrangements in railroad cars 440, 442, 444, 446, 448 and 450 having articulated connections substantially identical to those of car 218. FIGS. 11*c* to 11*h* show various side-bearing arm arrangements in railroad cars 460, 462, 464, 466, 468 and 470 having articulated connections substantially identical to those of car 330. FIGS. 12*c* to 12*h* show various side-bearing arm arrangements in railroad cars 470, 472, 474, 476, 478 and 480 having articulated connections substantially identical to those of car 282.

While various three-unit and five-unit articulated rail road car embodiments have been described in detail, it will be appreciated that other multi-unit articulated rail road cars having a larger number of rail car units can be assembled from the various types of rail car units described above.

Various modifications, variations and changes may be made to the embodiments of the invention described above without departing from the nature, spirit or scope of the invention. The invention is not to be limited to those specific embodiments.

The invention claimed is:

1. A multi-unit articulated railroad car, said multi-unit articulated railroad car consisting of a number of rail road car units interconnected by articulated connectors, and mounted on railroad car trucks for travel along rail road tracks;

said number of rail road car units of which said multi-unit articulated railroad car consists being an uneven number that is at least as great as three;

and wherein said multi-unit articulated railroad car comprises side-bearing arms mounted to said rail road car units adjacent said articulated connectors, said multi-unit articulated railroad car has a transverse centerline; and the articulated connectors and side-bearing arms are arranged symmetrically relative to said transverse centerline.

2. The multi-unit articulated railroad car of claim 1 wherein:

one of said rail road car units is a middle rail road car unit;

each said articulated connector has a male portion and a female portion; and said middle rail road car unit has two said male portions mounted thereto.

3. The multi-unit articulated railroad car of claim 1 wherein:

one of said rail road car units is a middle rail road car unit;

each said articulated connector has a male portion and a female portion; and said middle rail road car unit has two of said female portions mounted thereto.

4. The multi-unit articulated railroad car of claim 1 wherein:

one of said rail road car units is a middle rail road car unit carried between first and second ones of said railroad car trucks, and said middle rail road car unit has side-bearing arms mounted thereto, said side-bearing arms engaging bearing surfaces supported on said first and second railroad car trucks, said side-bearing arms being arranged symmetrically relative to said transverse centerline.

5. The multi-unit articulated railroad car of claim 1 wherein at least one of said rail road car units has a well defined therein for accommodating intermodal cargo.

6. A multi-unit articulated intermodal railroad car consisting of a number of interconnected rail road car units, the number of units of which said railroad car consists being an uneven number;

said number of interconnected rail road car units including at least first, second and third rail road car units carried on a plurality of rail car trucks;

said railroad car having a middle rail road car unit, said second rail road car unit being said middle rail road car unit;

said railroad car having a transverse central plane bisecting said middle rail road car unit;

the first rail road car unit being joined to the second rail road car unit at a first articulated connection mounted to a first of said rail car trucks and the second rail road car unit being joined to the third rail road car unit at a second articulated connection mounted to a second of said rail car trucks;

each articulated connection having a male articulated connector portion associated with an end of one rail road car unit and a mating female articulated connector portion associated with an end of an adjacent rail road car unit;

the second rail road car unit having a first end adjacent the first rail road car unit and a second end adjacent the third rail road car unit;

the second rail road car unit being chosen from the set of rail road car units having (a) male articulated connector portions at both of said first and second ends thereof; and (b) female articulated connector portions at both of said first and second ends thereof;

the first and third rail road car units each having an end adjacent the second rail road car unit, the first and third rail road car unit ends each having a mating articulated connector portion engageable with the respective articulated connector portion of the first and second ends of the second rail road car unit;

the second rail road car unit having a first pair of side-bearing arms mounted to the first end thereof and a second pair of side-bearing arms mounted to the second end thereof;

the first rail road car unit end having a third pair of side-bearing arms mounted thereto for locating opposite the first pair of side-bearing arms; and the third rail road car unit end having a fourth pair of side-bearing arms mounted thereto for locating opposite the second pair of side-bearing arms;

the first, second, third and fourth pairs of side-bearing arms being arranged symmetrically relative to said transverse central plane.

7. The multi-unit articulated intermodal railroad car of claim 6 wherein:

the articulated connector portion mounted to each end of the second rail road car unit is a female articulated connector portion; and the articulated connector portions mounted to the first and third rail road car unit ends are male articulated connector portions.

8. The multi-unit articulated intermodal railroad car of claim 6 wherein:

the articulated connector portion mounted to each end of the second rail road car unit is a male articulated connector portion; and the articulated connector portion mounted to the first and third rail road car unit ends are female articulated connector portions.

9. The multi-unit articulated intermodal railroad car of claim 7 wherein:

each side-bearing arm has a proximal end connected to a respective end of a rail road car unit and a distal end;

the side-bearing arms of the first pair are spaced away from each other a first distance measured center-to-center at the proximal ends thereof;

the side-bearing arms of the second pair are spaced away from each other a second distance measured center-to-center at the proximal ends thereof, the second distance being equal to the first distance;

the side-bearing arms of the third pair are spaced away from each other a third distance measured center-to-center at the proximal ends thereof; and the side-bearing arms of the fourth pair are spaced away from each other a fourth distance measured center-to-center at the proximal ends thereof; the fourth distance being equal to the third distance.

10. The multi-unit articulated intermodal railroad car of claim 9 wherein the third distance is greater than the first distance.

11. The multi-unit articulated intermodal railroad car of claim 10 wherein:

the first pair of side-bearing arms is nested within the third pair of side-bearing arms; and the second pair of side-bearing arms is nested within the fourth pair of side-bearing arms.

12. The multi-unit articulated intermodal railroad car of claim 10 wherein:

the first pair of side-bearing arms lies laterally inboard of the third pair of side-bearing arms; and the second pair of side-bearing arms lies laterally inboard of the fourth pair of side-bearing arms.

13. The multi-unit articulated intermodal railroad car of claim 12 wherein:

the side-bearing arms of the first pair extend away from the first end of the second road rail car unit in a mutually diverging manner; and the side-bearing arms of the third pair extend away from the third road rail car unit end in a mutually diverging manner.

14. The multi-unit articulated intermodal railroad car of claim 10 wherein:

the first pair of side-bearing arms lies between the third pair of side-bearing arms; and the second pair of side-bearing arms lies between the fourth pair of side-bearing arms.

15. The multi-unit articulated intermodal railroad car of claim 14 wherein the third distance is less than or equal to about 70 inches; and the first distance is at least about 42 inches.

16. The multi-unit articulated intermodal railroad car of claim 15 wherein the third distance is 60 inches and the first distance is 42 inches.

17. The multi-unit articulated intermodal railroad car of claim 15 wherein the third distance is 52 inches and the first distance is 48 inches.

18. The multi-unit articulated intermodal railroad car of claim 14 wherein:

the side-bearing arms of the first pair extend substantially perpendicular to the first end of the second road rail car unit; and the side-bearing arms of the third pair extend away from the third road rail car unit end in a mutually diverging manner.

19. The multi-unit articulated intermodal railroad car of claim 9 wherein the first distance is greater than the third distance.

20. The multi-unit articulated intermodal railroad car of claim 19 wherein:

the third pair of side-bearing arms is nested within the first pair of side-bearing arms; and the fourth pair of side-bearing arms is nested within the second pair of side-bearing arms.

21. The multi-unit articulated intermodal railroad car of claim 19 wherein:

the third pair of side-bearing arms lies laterally inboard of the first pair of side-bearing arms; and the fourth pair of side-bearing arms lies laterally inboard of the second pair of side-bearing arms.

22. The multi-unit articulated intermodal railroad car of claim 21 wherein:

the side-bearing arms of the first pair extend away from the first end of the second road rail car unit in a mutually diverging manner; and the side-bearing arms of the third pair extend away from the third rail road car unit end in a mutually diverging manner.

23. The multi-unit articulated intermodal railroad car of claim 19 wherein:

the third pair of side-bearing arms lies between the first pair of side-bearing arms; and the fourth pair of side-bearing arms lies between the second pair of side-bearing arms.

24. The multi-unit articulated intermodal railroad car of claim 23 wherein the first distance is less than or equal to about 70 inches; and the third distance is at least 42 inches.

25. The multi-unit articulated intermodal railroad car of claim 24 wherein the first distance is 60 inches and the third distance is 42 inches.

26. The multi-unit articulated intermodal railroad car of claim 24 wherein the first distance is 52 inches and the third distance is 48 inches.

27. The multi-unit articulated intermodal railroad car of claim 23 wherein:

the side-bearing arms of the third pair extend substantially perpendicular to the third rail road car unit end; and the side-bearing arms of the first pair extend away from the first end of the second rail road car unit in a mutually diverging manner.

28. The multi-unit articulated intermodal railroad car of claim 9 wherein the first distance is equal to the third distance.

29. The multi-unit articulated intermodal railroad car of claim 28 wherein:

the side-bearing arms of the first pair extend substantially perpendicular to the first end of the second rail road car unit;

the side-bearing arms of the second pair extend substantially perpendicular to the second end of the first rail road car unit;

the side-bearing arms of the third pair extend substantially perpendicular to the second rail road car unit end;

the side-bearing arms of the fourth pair extend substantially perpendicular to the third rail road car unit end.

30. The multi-unit articulated intermodal railroad car of claim 29 wherein:

the distal ends of the side-bearing arms of the first pair are aligned with the distal ends of the third pair of side-bearing arms; and the distal ends of the side-bearing arms of the second pair are aligned with the distal ends of the fourth pair of side-bearing arms.

31. The multi-unit articulated intermodal railroad car of claim 29 wherein the first distance is in the range of 50 inches to 70 inches.

32. The multi-unit articulated intermodal railroad car of claim 31 wherein the first distance is 50 inches.

33. The multi-unit articulated intermodal railroad car of claim 31 wherein the first distance is 70 inches.

34. The multi-unit articulated intermodal railroad car of claim 30 wherein:

the side-bearing arms of the first and third pairs are mutually engaging;

the side-bearing arms of the first pair has an upwardly facing bearing surface; and the side-bearing arms of the third pair has a downwardly facing bearing surface.

35. The multi-unit articulated intermodal railroad car of claim 30 wherein:

the side-bearing arms of the first and third pairs are mutually engaging;

the side-bearing arms of the first pair has a downwardly facing bearing surface; and the side-bearing arms of the third pair has an upwardly facing bearing surface.

36. The multi-unit articulated intermodal railroad car of claim 7 wherein each said articulated connection is carried at a first height above TOR; and the side-bearing arms of each pair are carried at a second height above TOR.

37. The multi-unit articulated intermodal railroad car of claim 36 wherein the second height is greater than the first height.

38. The multi-unit articulated intermodal railroad car of claim 37 wherein the second height is 37 inches above TOR.

39. The multi-unit articulated intermodal railroad car of claim 37 wherein the second height is 44 inches above TOR.

40. The multi-unit articulated intermodal railroad car of claim 36 wherein the second height is substantially equal to the first height.

* * * * *